US010369437B1

(12) United States Patent
Cleghorn et al.

(10) Patent No.: US 10,369,437 B1
(45) Date of Patent: Aug. 6, 2019

(54) WOOD-TYPE GOLF CLUB INCLUDING CENTER OF GRAVITY ADJUSTMENT

(71) Applicant: Acushnet Company, Fairhaven, MA (US)

(72) Inventors: Richard L. Cleghorn, Oceanside, CA (US); Nick Frame, Vista, CA (US); Mitchell E. Bac, Temecula, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 16/105,323

(22) Filed: Aug. 20, 2018

(51) Int. Cl.

| | |
|---|---|
| ***A63B 60/04*** | (2015.01) |
| ***A63B 53/04*** | (2015.01) |
| ***A63B 53/08*** | (2015.01) |
| ***A63B 53/06*** | (2015.01) |
| *A63B 102/32* | (2015.01) |
| *A63B 60/02* | (2015.01) |

(52) U.S. Cl.
CPC ..... *A63B 53/08* (2013.01); *A63B 53/0466* (2013.01); *A63B 53/06* (2013.01); *A63B 60/02* (2015.10); *A63B 60/04* (2015.10); *A63B 2102/32* (2015.10)

(58) Field of Classification Search
CPC ..... A63B 53/06; A63B 53/0466; A63B 53/04; A63B 2053/491; A63B 60/02; A63B 60/04
See application file for complete search history.

(56) References Cited

U.S. PATENT DOCUMENTS

| | | | |
|---|---|---|---|
| 80,435 | A | 7/1868 | Way |
| 996,937 | A | 7/1911 | Mulock |
| 1,133,129 | A | 3/1915 | Govan |
| 1,167,106 | A | 1/1916 | Palmer |
| 1,320,163 | A | 10/1919 | Murice Fitz |
| 1,322,182 | A | 11/1919 | Duncan |
| 1,534,600 | A | 4/1925 | Mattern |
| 2,155,830 | A | 4/1939 | Howard |
| 2,171,383 | A | 8/1939 | Wettlaufer |
| 2,214,356 | A | 9/1940 | Wettlaufer |

(Continued)

FOREIGN PATENT DOCUMENTS

| | | |
|---|---|---|
| GB | 2133295 | 7/1984 |
| JP | H06-238022 | 8/1994 |

(Continued)

*Primary Examiner* — John E Simms, Jr.
(74) *Attorney, Agent, or Firm* — Kevin N. McCoy

(57) ABSTRACT

A golf club head, including an adjustable weight system including a drive mechanism, a locking mechanism, and a weight, wherein the drive mechanism is rotatable about an axis of rotation, and the weight is slidable along an axis of translation, wherein the axis of rotation is perpendicular to the axis of translation at an interface of the drive mechanism and the weight, wherein the drive mechanism comprises a plurality of teeth, wherein the weight comprises a plurality of cogs, wherein the plurality of teeth of the drive mechanism engage the plurality of cogs of the weight so that rotation of the drive mechanism about an axis of rotation forces the weight to translate along the axis of translation, wherein a component of the locking mechanism translates between an unlocked position and a locked position in a direction parallel to the axis of rotation of the drive mechanism.

20 Claims, 20 Drawing Sheets

(56) References Cited

U.S. PATENT DOCUMENTS 2,517,245 A 8/1950 Scott
2,545,045 A 3/1951 Rosan
2,592,013 A 4/1952 Curley
2,652,256 A 9/1953 Thomas
3,064,980 A 11/1962 Steiner
3,212,783 A 10/1965 Bradley et al.
3,220,733 A 11/1965 Saleeby
3,259,404 A 7/1966 Papenguth
3,466,047 A 9/1969 Rodia et al.
3,556,533 A 1/1971 Hollis
3,604,755 A 9/1971 Krekeler
3,652,094 A 3/1972 Glover
3,692,306 A 9/1972 Glover
3,979,123 A 9/1976 Belmont
4,026,183 A 5/1977 Bart
4,027,881 A 6/1977 Hufenus
4,043,563 A 8/1977 Churchward
4,052,075 A 10/1977 Daly
4,085,934 A 4/1978 Churchward
4,150,464 A 4/1979 Tracy
4,194,547 A 3/1980 Sidor et al.
4,340,230 A 7/1982 Churchward
4,423,874 A 1/1984 Stuff, Jr.
4,443,145 A 4/1984 Peschges
4,450,904 A 5/1984 Volz
4,538,790 A 9/1985 Williams et al.
4,602,787 A 7/1986 Sugioka et al.
4,795,159 A 1/1989 Nagamoto
4,867,458 A 9/1989 Sumikawa et al.
4,869,507 A 9/1989 Sahm
4,883,274 A 11/1989 Hsien
4,895,371 A 1/1990 Bushner
4,958,970 A 9/1990 Rose et al.
5,050,879 A 9/1991 Sun et al.
5,154,424 A 10/1992 Lo
5,168,767 A 12/1992 Morita
5,230,509 A 7/1993 Chavez
5,236,164 A 8/1993 Lorizzo
5,297,794 A 3/1994 Lu
5,316,305 A 5/1994 McCabe
5,320,005 A 6/1994 Hsiao
5,441,274 A 8/1995 Truman
5,518,243 A 5/1996 Redman
5,547,326 A 8/1996 Overhues
5,571,053 A 11/1996 Lane
5,683,309 A 11/1997 Reimers
5,688,189 A 11/1997 Bland
5,720,674 A 2/1998 Galy
5,769,737 A 6/1998 Holladay
5,794,316 A 8/1998 Anscher
5,795,245 A 8/1998 Chang et al.
5,860,779 A 1/1999 Toosky et al.
5,904,460 A 5/1999 Kawabata
5,916,042 A 6/1999 Reimers
5,935,019 A 8/1999 Yamamoto
5,947,840 A 9/1999 Ryan
5,967,905 A 10/1999 Nakahara et al.
6,015,354 A 1/2000 Ahn
6,017,177 A 1/2000 Lanham
6,056,649 A 5/2000 Imai
6,089,994 A 7/2000 Sun
6,123,627 A 9/2000 Antonious
6,162,132 A 12/2000 Yoneyama
6,217,461 B1 4/2001 Galy
6,277,032 B1 * 8/2001 Smith ..... A63B 53/04 473/336
6,296,574 B1 10/2001 Kaldis
6,306,048 B1 10/2001 McCabe et al.
6,348,014 B1 2/2002 Chiu
6,379,264 B1 4/2002 Forzano
6,379,265 B1 4/2002 Hirakawa et al.
6,409,612 B1 6/2002 Evans et al.
6,436,142 B1 8/2002 Paes et al.
6,458,044 B1 10/2002 Vincent et al.
6,648,772 B2 11/2003 Vincent et al.
6,719,510 B2 4/2004 Cobzaru
6,749,523 B1 6/2004 Forzano
6,773,360 B2 8/2004 Willett et al.
6,811,496 B2 11/2004 Wahl et al.
6,860,818 B2 3/2005 Mahaffey et al.
6,881,158 B2 4/2005 Yang et al.
6,902,432 B2 6/2005 Morikawa
6,988,960 B2 1/2006 Mahaffey et al.
7,121,956 B2 10/2006 Lo
7,147,573 B2 12/2006 DiMarco
7,153,220 B2 12/2006 Lo
7,166,040 B2 1/2007 Hoffman et al.
7,166,041 B2 1/2007 Evans
7,179,034 B2 2/2007 Ladouceur
7,186,190 B1 3/2007 Beach et al.
7,189,169 B2 3/2007 Billings
7,201,669 B2 4/2007 Stites
7,223,180 B2 5/2007 Willett et al.
7,273,423 B2 9/2007 Imamoto
7,294,065 B2 11/2007 Liang et al.
7,326,472 B2 2/2008 Shimazaki et al.
7,351,161 B2 4/2008 Beach
7,404,772 B2 7/2008 Koide
7,407,447 B2 8/2008 Beach
7,410,425 B2 8/2008 Willett et al.
7,410,426 B2 8/2008 Willett et al.
7,419,441 B2 9/2008 Hoffman et al.
7,448,963 B2 11/2008 Beach et al.
7,452,285 B2 11/2008 Chao et al.
7,452,286 B2 11/2008 Lin
7,520,820 B2 4/2009 Dimarco
7,530,901 B2 5/2009 Imamoto
7,530,904 B2 5/2009 Beach et al.
7,540,811 B2 6/2009 Beach et al.
7,568,985 B2 8/2009 Beach et al.
7,572,193 B2 8/2009 Yokota
7,578,753 B2 8/2009 Beach et al.
7,591,738 B2 9/2009 Beach
7,604,548 B2 10/2009 Cole
7,611,424 B2 11/2009 Nagai
7,621,823 B2 11/2009 Beach
7,628,707 B2 12/2009 Beach
7,628,711 B2 12/2009 Akinori et al.
7,632,194 B2 12/2009 Beach et al.
7,670,235 B2 3/2010 Lo
7,704,163 B2 4/2010 Stites
7,713,142 B2 5/2010 Hoffman et al.
7,717,803 B2 5/2010 DiMarco
7,717,804 B2 5/2010 Beach et al.
7,717,805 B2 5/2010 Beach et al.
D617,858 S 6/2010 Llewellyn
7,744,484 B1 6/2010 Chao et al.
7,758,452 B2 7/2010 Soracco
7,771,290 B2 8/2010 Bezilla et al.
7,775,905 B2 8/2010 Beach et al.
7,806,781 B2 10/2010 Imamoto
7,806,782 B2 10/2010 Stites
7,824,280 B2 11/2010 Yokota
7,846,041 B2 12/2010 Beach
7,927,231 B2 4/2011 Sato
7,963,861 B2 6/2011 Beach
8,016,694 B2 9/2011 Llewellyn
8,043,167 B2 10/2011 Boyd et al.
8,066,584 B2 11/2011 Stites
8,092,316 B2 1/2012 Breier et al.
8,105,175 B2 1/2012 Breier et al.
8,182,363 B2 5/2012 Bezilla et al.
8,192,302 B2 6/2012 Knutson et al.
8,192,303 B2 6/2012 Ban
8,202,175 B2 6/2012 Ban
8,206,243 B2 6/2012 Stites
8,292,757 B2 10/2012 Soracco
8,298,096 B2 10/2012 Stites
8,308,583 B2 11/2012 Morris
8,388,465 B2 3/2013 De La Cruz et al.
8,435,135 B2 5/2013 Stites et al.
8,435,136 B2 5/2013 Stites
8,444,505 B2 5/2013 Beach
8,540,589 B2 9/2013 Bezilla et al.

(56) References Cited

U.S. PATENT DOCUMENTS 8,562,457 B2 10/2013 Beach
8,684,863 B2 4/2014 Bezilla et al.
8,690,706 B2 4/2014 Stites
8,696,491 B1 4/2014 Myers
8,734,271 B2 5/2014 Beach
D709,571 S 7/2014 Sargent
D709,572 S 7/2014 Sargent
8,790,195 B1 7/2014 Myers
8,834,294 B1 9/2014 Seluga
8,870,678 B2 10/2014 Beach
8,888,607 B2 11/2014 Harbert
8,894,506 B1 11/2014 Myers
8,900,069 B2 12/2014 Beach
8,968,116 B1 3/2015 Myers
9,084,921 B1 7/2015 Liang
9,095,753 B2 8/2015 Bezilla et al.
9,174,096 B2 11/2015 Sargent
9,180,349 B1 11/2015 Seluga
9,186,560 B2 11/2015 Harbert
9,199,145 B1 12/2015 Myers
9,211,447 B2 12/2015 Harbert
9,211,453 B1 12/2015 Foster
9,220,953 B2 12/2015 Beach
9,220,957 B1* 12/2015 Myers ..... A63B 53/0466
9,238,162 B2 1/2016 Breier
9,259,625 B2 2/2016 Sargent
9,259,627 B1 2/2016 Myers
9,278,262 B2 3/2016 Sargent
9,289,660 B1 3/2016 Myers
9,308,423 B1 4/2016 Tang
9,364,728 B1 6/2016 Myers
9,364,729 B2 6/2016 Myers
9,375,618 B2 6/2016 Myers
9,387,376 B1 7/2016 Hall
9,387,377 B2 7/2016 Liang
9,433,836 B2 9/2016 Breier
9,623,294 B1 4/2017 Kingston
9,682,296 B1 6/2017 Myers
9,682,298 B1 6/2017 Kingston
9,694,261 B2 7/2017 Nunez
9,700,764 B2 7/2017 Carter
9,700,771 B2 7/2017 Murphy
9,731,175 B1 8/2017 Meyers
9,744,415 B2 8/2017 Frame
9,802,084 B2 10/2017 Shimahara
9,884,231 B2 2/2018 Hebreo
9,914,028 B1 3/2018 Cleghorn
9,975,019 B2 5/2018 Frame et al.
2003/0148818 A1 8/2003 Myrhum et al.
2004/0248675 A1* 12/2004 Brock ..... A63B 69/0002 473/457
2006/0058112 A1 3/2006 Haralason et al.
2006/0100029 A1 5/2006 Lo
2006/0122004 A1 6/2006 Chen et al.
2006/0217216 A1 9/2006 Iizuka
2006/0240908 A1 10/2006 Adams
2007/0135231 A1* 6/2007 Lo ..... A63B 53/0466 473/336
2007/0155534 A1 7/2007 Tsai et al.
2007/0178988 A1 8/2007 Tavares
2007/0249432 A1* 10/2007 Wu ..... A63B 53/04 473/340
2008/0020861 A1 1/2008 Adams
2008/0039229 A1 2/2008 Lo
2008/0132353 A1 6/2008 Hsiao
2008/0261715 A1 10/2008 Carter
2009/0143167 A1 6/2009 Evans
2009/0221380 A1 9/2009 Breier
2010/0075773 A1 3/2010 Casati
2010/0331101 A1* 12/2010 Sato ..... A63B 53/0466 473/336
2010/0331103 A1* 12/2010 Takahashi ..... A63B 53/0466 473/338
2014/0018185 A1 1/2014 Mizutani
2014/0113741 A1 4/2014 Bezilla
2014/0113742 A1 4/2014 Zimmerman
2014/0206474 A1 7/2014 Bezilla
2015/0038258 A1 2/2015 Beach
2015/0087439 A1* 3/2015 Song ..... A63B 60/00 473/335
2015/0111661 A1 4/2015 Bennett
2015/0297959 A1* 10/2015 Lee ..... A63B 53/0466 473/332
2015/0306474 A1 10/2015 Breier
2015/0306475 A1 10/2015 Curtis
2015/0321055 A1* 11/2015 Golden ..... A63B 53/0466 473/338
2015/0378107 A1 12/2015 Akashi
2016/0001146 A1 1/2016 Sargent
2016/0008687 A1 1/2016 Sargent
2016/0023060 A1 1/2016 Harbert
2016/0051869 A1 2/2016 Foster
2016/0059093 A1 3/2016 Nielson
2016/0059094 A1 3/2016 Mata
2016/0074720 A1* 3/2016 Kline ..... A63B 53/06 473/223
2016/0089583 A1 3/2016 Breier
2016/0129323 A1* 5/2016 Myers ..... A63B 53/0466 473/338
2016/0136490 A1 5/2016 Sargent
2016/0175668 A1 6/2016 Tang
2016/0375326 A1* 12/2016 Nunez ..... A63B 60/52 473/335
2017/0173413 A1 6/2017 Cleghorn
2017/0173420 A1 6/2017 Frame
2018/0117427 A1* 5/2018 Knutson ..... A63B 53/0466

FOREIGN PATENT DOCUMENTS

JP 10137374 5/1998
JP 10234902 9/1998
JP 10248964 9/1998
JP 11319167 11/1999
JP 2000-005350 1/2000
JP 2000-176059 6/2000
JP 2001-000606 1/2001
JP 2001-149514 6/2001
JP 2002-011124 1/2002
JP 2004-307011 11/2004
JP 3109501 3/2005
JP 2005-160947 6/2005
JP 2005-296582 10/2005
JP 2005-323978 11/2005
JP 2006-000435 1/2006
JP 2006-081862 3/2006
JP 2006-122334 5/2006
JP 2006-187489 7/2006
JP 2006-198251 8/2006
JP 2006-239154 9/2006
JP 2006-320493 11/2006
JP 2007-313304 12/2007
JP 2011-229914 11/2011
WO WO 2009-102661 8/2009

* cited by examiner

WOOD-TYPE GOLF CLUB INCLUDING CENTER OF GRAVITY ADJUSTMENT

TECHNICAL FIELD

This present technology generally relates to systems, devices, and methods related to golf clubs, and more specifically to a wood-type golf club head with improved physical attributes.

DESCRIPTION OF THE RELATED TECHNOLOGY

Golf club heads come in many different forms and makes, such as wood- or metal-type (including drivers and fairway woods), iron-type (including wedge-type club heads), utility- or specialty-type, and putter-type. Each of these styles has a prescribed function and make-up. The present invention relates primarily to hollow golf club heads, such as wood-type and utility-type (generally referred to herein as wood-type golf clubs).

Wood-type or metal-type golf club heads generally include a front or striking face, a crown, a sole, and an arcuate skirt including a heel, a toe and a back. The crown and skirt are sometimes referred to as a shell. The front face interfaces with and strikes the golf ball. A plurality of grooves, sometimes referred to as "score lines," may be provided on the face to assist in imparting spin to the ball and for decorative purposes. The crown is generally configured to have a particular look to the golfer and to provide structural rigidity for the striking face. The sole of the golf club is particularly important to the golf shot because it contacts and interacts with the ground during the swing.

The complexities of golf club design are well known. The specifications for each component of the club (i.e., the club head, shaft, grip, and subcomponents thereof) directly impact the performance of the club. Thus, by varying the design specifications, a golf club can be tailored to have specific performance characteristics.

The design and manufacture of wood-type club heads requires careful attention to club head construction. Among the many factors that must be considered are material selection, material treatment, structural integrity and overall geometrical design. Exemplary geometrical design considerations include loft, lie, face angle, horizontal face bulge, vertical face roll, face size, center of gravity, sole curvature, and overall head weight. The interior design of the club head may be tailored to achieve particular characteristics, such as by including hosel or shaft attachment means, perimeter weighting on the face or body of the club head, and fillers within hollow club heads. Club heads are typically formed from stainless steel, aluminum, or titanium and are cast, stamped, as by forming sheet metal with pressure, forged, or formed by a combination of any two or more of these processes.

The club heads may be formed from multiple pieces that are welded or otherwise joined together to form a hollow head, as is often the case of club heads designed with inserts, such as soleplates or crown plates. The multi-piece constructions facilitate access to the cavity formed within the club head, thereby permitting the attachment of various other components to the head such as internal weights and the club shaft. The cavity may remain empty, or may be partially or completely filled, such as with foam. An adhesive may be injected into the club head to provide the correct swing weight and to collect and retain any debris that may be in the club head. In addition, due to difficulties in manufacturing one-piece club heads to high dimensional tolerances, the use of multi-piece constructions allows the manufacture of a club head to a tight set of standards.

It is known to make wood-type golf clubs out of metallic materials. These clubs were originally manufactured primarily by casting durable metals such as stainless steel, aluminum, beryllium copper, etc. into a unitary structure comprising a metal body, face and hosel. As technology progressed, it became more desirable to increase the performance of the face of the club, usually by using a titanium material.

Players generally seek a metal wood driver and golf ball combination that delivers maximum distance and landing accuracy. The distance a ball travels after impact is dictated by the magnitude and direction of the ball's translational velocity and the ball's rotational velocity or spin. Environmental conditions, including atmospheric pressure, humidity, temperature, and wind speed, further influence the ball's flight. However, these environmental effects are beyond the control of the golf equipment manufacturer. Golf ball landing accuracy is driven by a number of factors as well. Some of these factors are attributed to club head design, such as center of gravity and club face flexibility.

Known methods to enhance the weight distribution of wood-type club heads to help keep the club face square through impact as well as optimize gear effect spin and momentum transfer to the golf ball usually include the addition of weights to the body casting itself or strategically adding a weight element at some point in the club. Many efforts have been made to incorporate weight elements into the wood-type club head. These weight elements are usually placed at specific locations, which can have a positive influence on the flight of the ball as well as overcome a particular golfer's swing shortcomings.

SUMMARY

The systems, methods, and devices described herein have innovative aspects, no single one of which is indispensable or solely responsible for their desirable attributes. Without limiting the scope of the claims, some of the advantageous features will now be summarized.

One non-limiting embodiment of the present technology includes a golf club head, including a body having a face defining a ball striking surface, a crown extending from an edge of the face, a sole extending from an edge of the face, and a skirt extending between the crown and the sole; and an adjustable weight system including a drive mechanism, a locking mechanism, and a weight; wherein the drive mechanism is rotatable about an axis of rotation, and the weight is slidable along an axis of translation; wherein the axis of rotation is perpendicular to the axis of translation at an interface of the drive mechanism and the weight; wherein the drive mechanism comprises a plurality of teeth; wherein the weight comprises a plurality of cogs that complement the plurality of teeth of the drive mechanism; wherein the plurality of teeth of the drive mechanism engage the plurality of cogs of the weight so that rotation of the drive mechanism about an axis of rotation forces the weight to translate along the axis of translation; wherein a component of the locking mechanism translates between an unlocked position and a locked position in a direction parallel to the axis of rotation of the drive mechanism; and wherein the locking mechanism directly engages and prevents movement of at least one of the drive mechanism and the slidable weight.

In an additional non-limiting embodiment of the present technology the golf club head comprises a curved weight channel.

In an additional non-limiting embodiment of the present technology the weight channel comprises a plurality of radii of curvature.

In an additional non-limiting embodiment of the present technology the weight is flexible, allowing the weight to conform and translate smoothly along the curved weight channel.

In an additional non-limiting embodiment of the present technology the adjustable weight system comprises a first set of teeth located on the drive mechanism, and a second set of teeth affixed to the body, wherein the locking mechanism biases the first set of teeth to engage the second set of teeth, locking the locking mechanism, and wherein forcing the first set of teeth in a direction parallel to the axis of rotation disengages the first set of teeth from the second set of teeth, unlocking the locking mechanism.

In an additional non-limiting embodiment of the present technology the locking mechanism comprises a spring configured to bias the first set of teeth to engage the second set of teeth.

In an additional non-limiting embodiment of the present technology the locking mechanism comprises a fastener configured to bias the first set of teeth to engage the second set of teeth.

In an additional non-limiting embodiment of the present technology the adjustable weight system is constructed separately from the golf club head and affixed to the golf club head.

9. The golf club head of claim 1, wherein the body comprises an aperture formed therein, and wherein the adjustable weight system is affixable to the golf club head in a plurality of angular positions.

In an additional non-limiting embodiment of the present technology the adjustable weight system further comprises a weight channel, wherein the weight channel comprises a slot, and wherein the cross section of the weight channel complements the cross section of the weight.

An additional non-limiting embodiment of the present technology includes a golf club head, including a body having a face defining a ball striking surface, a crown extending from an edge of the face, a sole extending from an edge of the face, and a skirt extending between the crown and the sole; and an adjustable weight system including a drive mechanism, a locking mechanism, and a weight; wherein the drive mechanism is rotatable about an axis of rotation, and the weight is slidable along an axis of translation; wherein the axis of rotation is perpendicular to the axis of translation at an interface of the drive mechanism and the weight; wherein the weight resides in a curved weight channel; wherein the weight is flexible, allowing the weight to conform and translate smoothly along the weight channel; wherein the drive mechanism comprises a plurality of teeth; wherein the weight comprises a plurality of cogs that complement the plurality of teeth of the drive mechanism; wherein the plurality of teeth of the drive mechanism engage the plurality of cogs of the weight so that rotation of the drive mechanism about an axis of rotation forces the weight to translate along the axis of translation; wherein a component of the locking mechanism translates between an unlocked position and a locked position in a direction parallel to the axis of rotation of the drive mechanism; and wherein the locking mechanism directly engages and prevents movement of at least one of the drive mechanism and the slidable weight.

In an additional non-limiting embodiment of the present technology the weight channel comprises a plurality of radii of curvature.

In an additional non-limiting embodiment of the present technology the weight channel is adjacent the skirt of the body.

In an additional non-limiting embodiment of the present technology the weight is formed of an elastomeric material.

In an additional non-limiting embodiment of the present technology the weight further comprises a plurality of insert bores, each configured to house a weight insert.

An additional non-limiting embodiment of the present technology includes a golf club head, including a body having a face defining a ball striking surface, a crown extending from an edge of the face, a sole extending from an edge of the face, and a skirt extending between the crown and the sole; and an adjustable weight system including a drive mechanism, a locking mechanism, and a weight; wherein the drive mechanism is rotatable about an axis of rotation, and a weight that is slidable along an axis of translation; wherein the axis of rotation is perpendicular to the axis of translation at an interface of the drive mechanism and the weight; wherein the drive mechanism comprises a dial locking member, the dial locking member comprises a plurality of locking teeth and a plurality of drive teeth; wherein the locking mechanism comprises a dial cover including a locking feature; wherein the locking feature of the dial cover engages the locking teeth of the dial locking member, directly preventing the rotational movement of the drive mechanism when the locking mechanism is in a locked position; wherein engaging the drive mechanism and applying a force parallel to the axis of rotation translates the dial locking member from a locked position to an unlocked position; wherein the weight comprises a plurality of cogs that complement the plurality of drive teeth of the drive mechanism; and wherein the plurality of drive teeth of the drive mechanism engage the plurality of cogs of the weight so that rotation of the drive mechanism about an axis of rotation forces the weight to translate along the axis of translation.

In an additional non-limiting embodiment of the present technology rotating the drive mechanism, while in the unlocked position, in a first direction causes the weight to translate in a first direction, and wherein rotating the drive mechanism, while in the unlocked position, in a second direction, opposite the first, causes the weight to translate in a second direction, opposite the first.

In an additional non-limiting embodiment of the present technology the locking mechanism further comprises a spring configured to bias the locking teeth of the dial locking member to engage the locking feature of the dial cover, and applying the force parallel to the axis of rotation compresses the spring and disengages the dial locking member from the dial cover.

In an additional non-limiting embodiment of the present technology the locking teeth of the dial locking member protrude towards the cover.

In an additional non-limiting embodiment of the present technology the drive mechanism further comprises a dial, and wherein the body comprises a cavity configured to house the spring and the dial, and wherein the cavity comprises a cavity width greater than a diameter of the dial, and wherein a distance between a base of the cavity and the dial in an unlocked position is greater than the height of the locking teeth of the dial locking member, allowing the dial to translate to the unlocked position and rotate relative to the body.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

The accompanying drawings form a part of the specification and are to be read in conjunction therewith. The illustrated embodiments, however, are merely examples and are not intended to be limiting. Like reference numbers and designations in the various drawings indicate like elements.

DETAILED DESCRIPTION

Figure 1A:
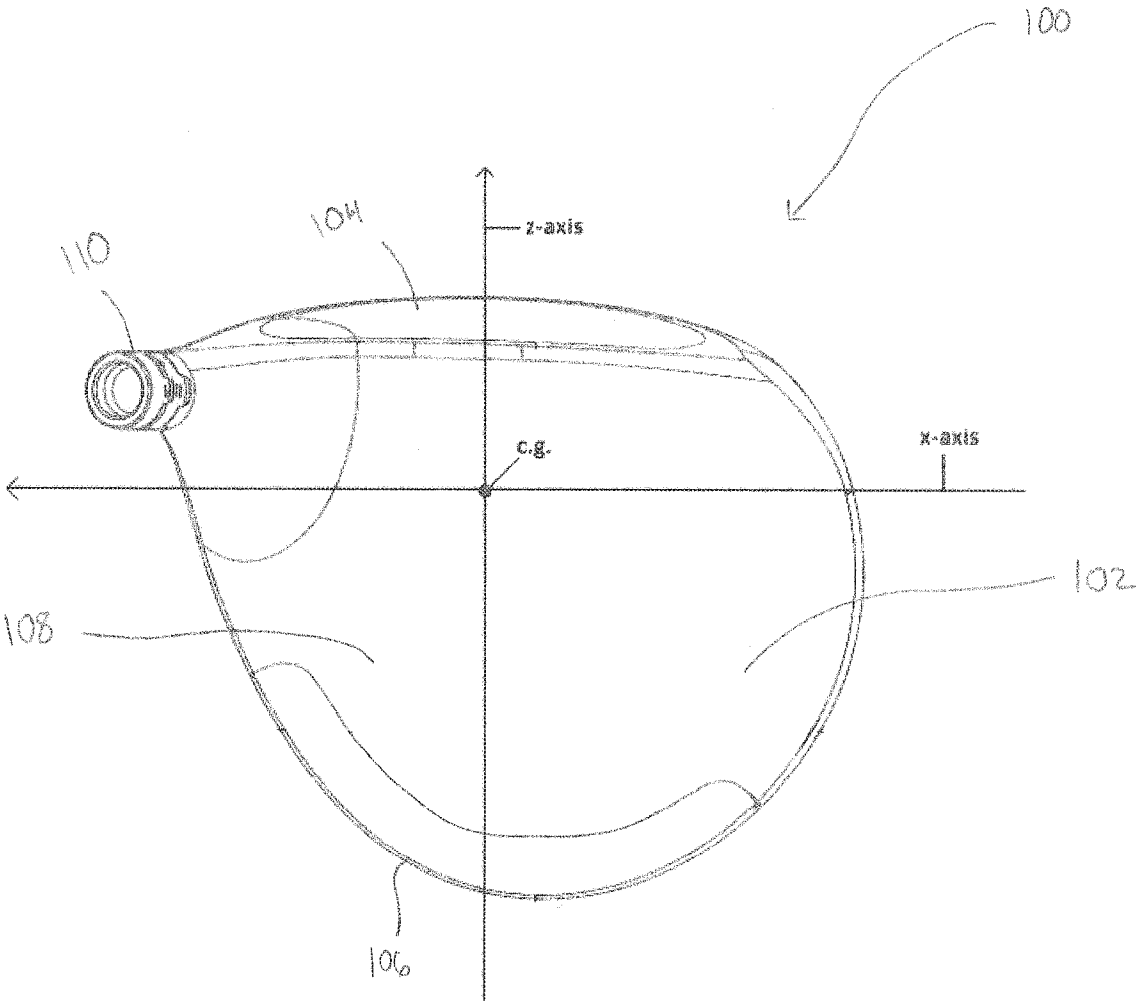
FIG. 1A illustrates a top view of one embodiment of a golf club head including a center of gravity.

In the following detailed description, reference is made to the accompanying drawings, which form a part of the present disclosure. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, and designed in a wide variety of different configurations, all of which are explicitly contemplated and form part of this disclosure. For example, a system or device may be implemented or a method may be practiced using any number of the aspects set forth herein. In addition, such a system or device may be implemented or such a method may be practiced using other structure, functionality, or structure and functionality in addition to or other than one or more of the aspects set forth herein. Alterations and further modifications of inventive features illustrated herein, and additional applications of the principles of the inventions as illustrated herein, which would occur to one skilled in the relevant art and having possession of this disclosure, are to be considered within the scope of the invention.

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

In describing the present technology, the following terminology may have been used: The singular forms "a," "an," and "the" include plural referents unless the context clearly dictates otherwise. Thus, for example, reference to an item includes reference to one or more items. The term "plurality" refers to two or more of an item. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. A plurality of items may be presented in a common list for convenience. However, these lists should be construed as though each member of the list is individually identified as a separate and unique member. Thus, no individual member of such list should be construed as a de facto equivalent of any other member of the same lists solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to a selection of one of two or more alternatives, and is not intended to limit the selection of only those listed alternative or to only one of the listed alternatives at a time, unless the context clearly indicated otherwise.

Features of the present disclosure will become more fully apparent from the following description and appended claims, taken in conjunction with the accompanying drawings. After considering this discussion, and particularly after reading the section entitled "Detailed Description" one will understand how the illustrated features serve to explain certain principles of the present disclosure.

Embodiments described herein generally relate to systems, devices, and methods related to golf clubs. More specifically, some embodiments relate to a golf club head incorporating an adjustable weight system.

Figure 1B:
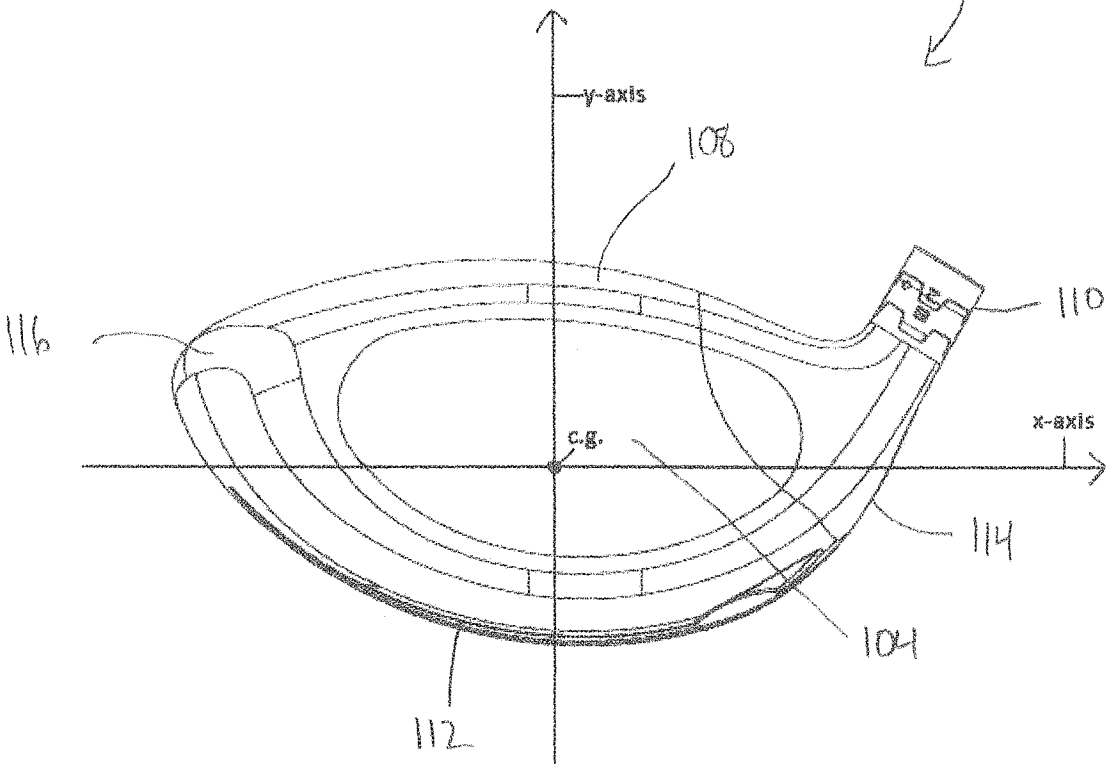
FIG. 1B illustrates a front view of the golf club head of FIG. 1A.

FIGS. 1A and 1B illustrate one embodiment of a golf club head 100 including a coordinate system with an x-axis, a y-axis, and a z-axis.

The golf club head 100 includes a body 102 having a striking face 104, a skirt 106, a crown 108, a hosel 110, a sole 112, a heel 114, and a toe 116. The golf club head 100 defines a hollow interior volume. The coordinate system is defined relative to the golf club head 100 at address resting on a ground plane. The x-axis of golf club head 100 is oriented parallel to the ground plane and runs from the toe 116 to heel 114 portion of the golf club head 100. The y-axis, perpendicular to the x-axis, runs perpendicular to the ground plane from the sole 112 to crown 108 portion of the golf club head 100. The z-axis runs through the striking face 104 from the skirt 106 to the striking face 104 portion of the golf club head 100. The y-axis is perpendicular to both the x-axis and y-axis.

There also exists a point on golf club head 100 signifying the location of the center of gravity (c.g.) of golf club head 100. In order to improve the playability and performance of the golf club head 100 it is desired to be able to move the location of the c.g. within the golf club head 100 to find a more optimal position. Preferably, the golf club head 100 can incorporate an adjustable weight system 202, as shown in FIGS. 2-8, allowing the user to adjust the location of the c.g. of the golf club head 100, along the x-axis, y-axis, and z-axis. In some embodiments, the c.g. location may be moved substantially along the x-axis. In some embodiments, the c.g. location may be moved substantially along the z-axis. In some embodiments, the c.g. location may be moved along both the x-axis and z-axis. In some embodiments, the c.g. location may also be moved along the y-axis.

Figure 2:
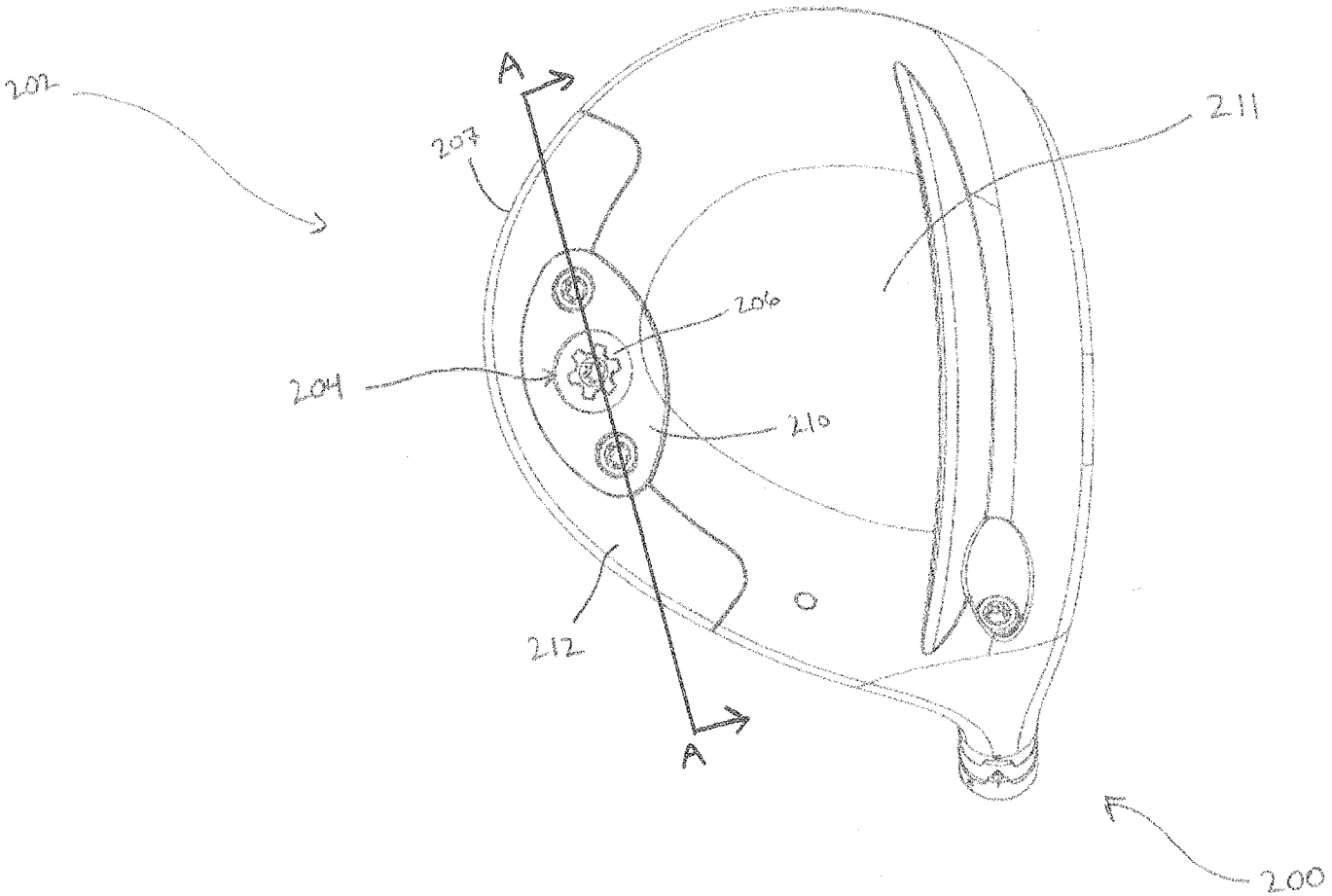
FIG. 2 illustrates a bottom view of one embodiment of a golf club head including a weight system configured to adjust the center of gravity of the golf club head.
Figure 3:
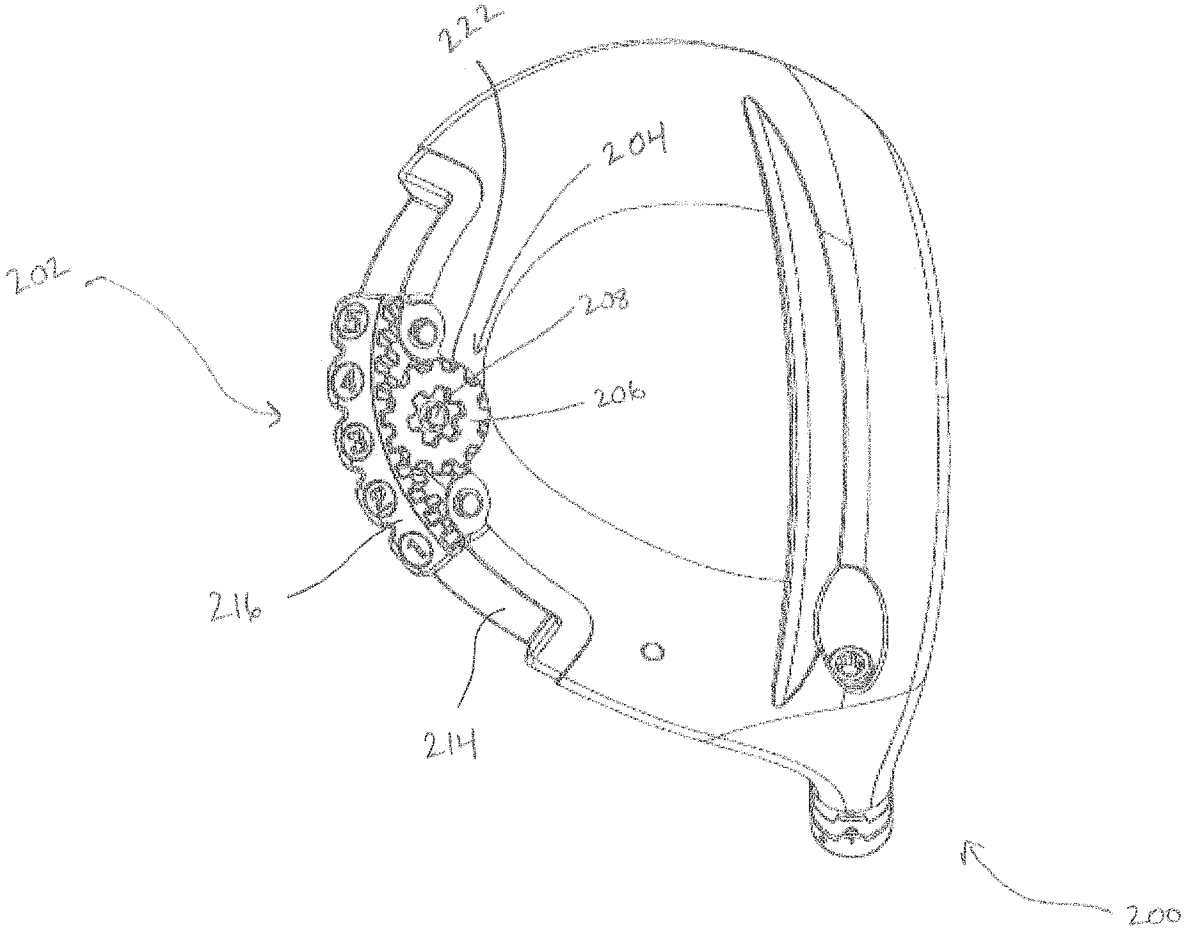
FIG. 3 illustrates a bottom view of the golf club head in FIG. 2 showing internal components of an adjustable weight system.

FIGS. 2 and 3 illustrate a bottom view of one embodiment of a golf club head 200 including an adjustable weight system 202 configured to adjust the c.g. location of the body of the golf club head 200 along both the x-axis and z-axis. The adjustable weight system 202 includes both a drive mechanism and a locking mechanism. The drive mechanism includes a dial 206 which incorporates a gear 222 rotatable about an axis of rotation, configured to engage a weight 216 that is slidable along an axis of translation. The axis of translation may be curved, as illustrated in FIG. 3, or linear, and is perpendicular to the axis of rotation at an interface of the dial 206 and the weight 216. The locking mechanism includes a dial locking member 220 configured to translate, parallel the axis of rotation, between a locked and an unlocked position. When locked, the locking mechanism directly holds the drive mechanism in place by preventing rotation of the dial 206. When unlocked, the dial 206 may be rotated in order to translate the weight 216.

The adjustable weight system includes a dial housing 204 which houses components of the adjustable weight system 202. The dial housing 204 includes a dial cover 210 and a dial 206. The adjustable weight system 202 also includes a weight cover 212 configured to retain a weight 216, wherein the weight 216 can slide inside of the weight channel 214.

Figure 7:
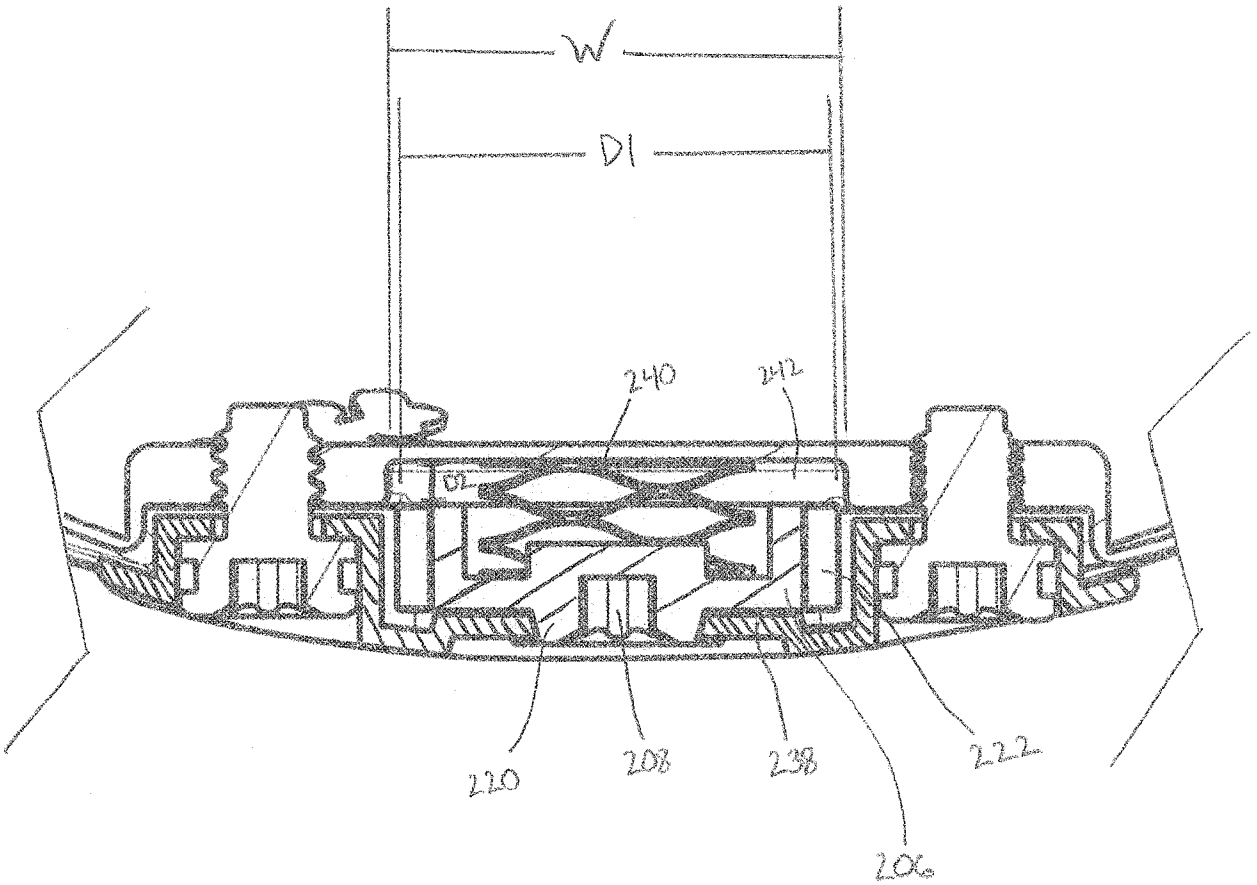
FIG. 7 illustrates a detail view of the adjustable weight system of FIG. 6 in a locked position.

There are features formed in the sole 211 of golf club head 200 during the casting process which includes the weight channel 214, and a cavity 242 configured to house the dial 206 and a spring 240, as illustrated in FIG. 7. In other embodiments, the adjustable weight system 202 can reside in other portions of the golf club head 200 without departing from the scope of the current disclosure, including other portions of the sole.

The dial cover 210 is held in place by at least one fastener that attaches the dial cover 210 to the body of golf club head 200. FIG. 2 illustrates the dial cover 210 engaged by two fasteners, but the dial cover 210 may be engaged by fewer or more than two fasteners without departing from the scope of the current disclosure. Additionally, the weight cover 212 may be attached to the body of golf club head 200 through a variety of methods including welding, adhesives, etc.

Figure 4:
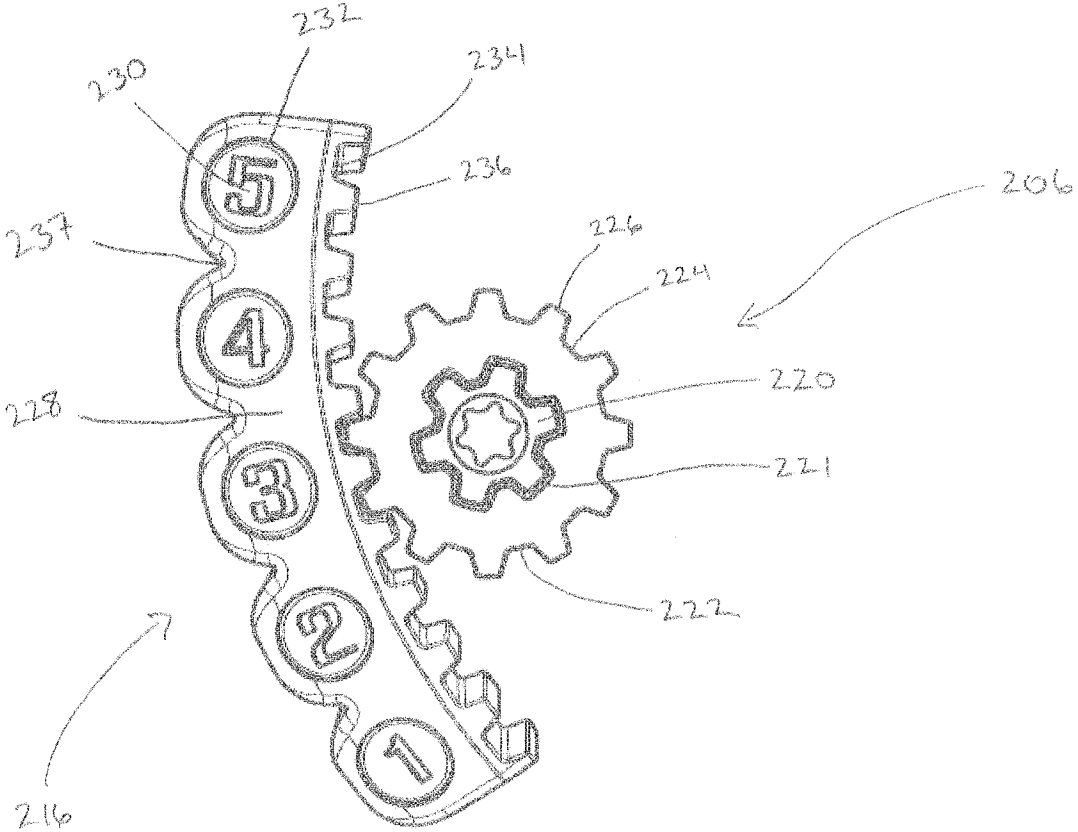
FIG. 4 illustrates the relationship between the weight and dial of the adjustable weight system of the golf club head of FIG. 2.
Figure 5:
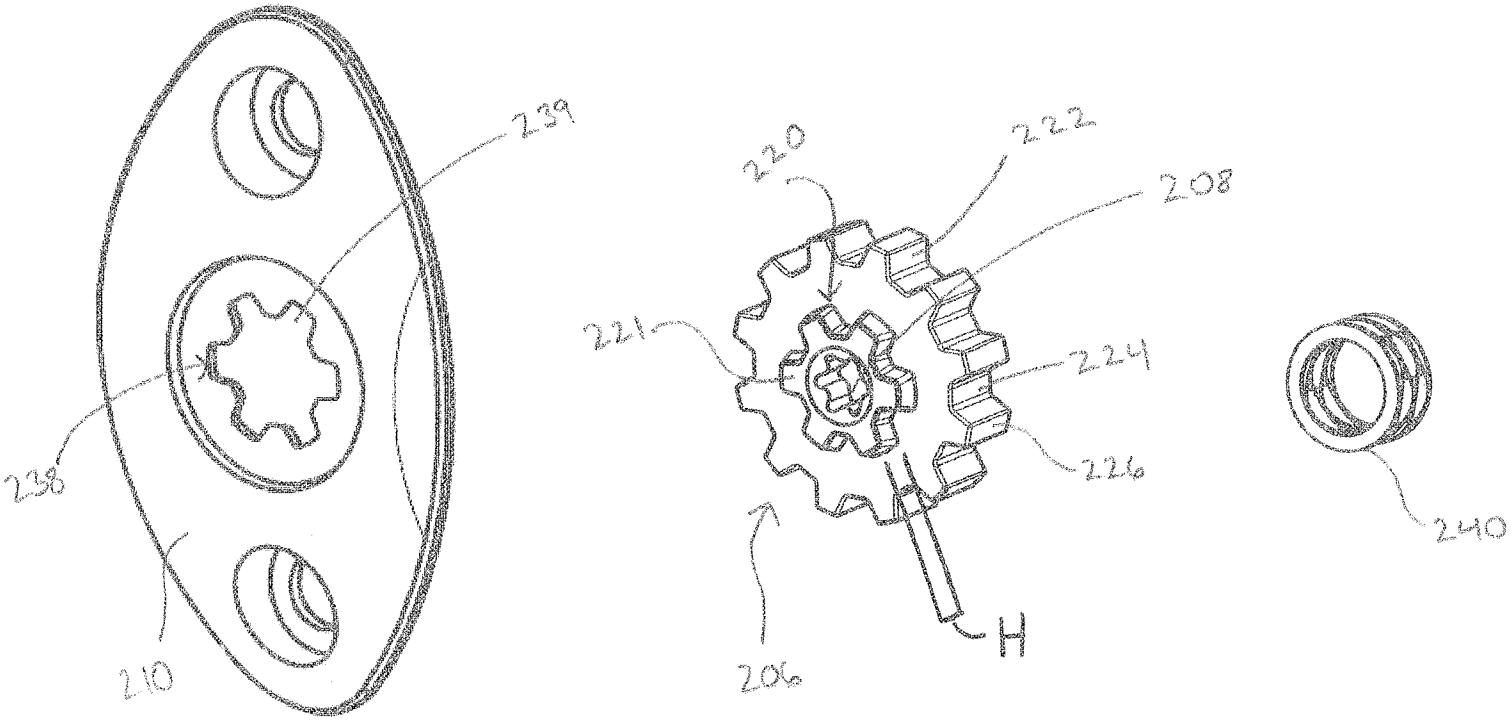
FIG. 5 illustrates an exploded perspective view of the locking mechanism of the adjustable weight system of the golf club head of FIG. 2.

The dial 206 meshes with the weight 216 as shown in FIG. 4. The dial 206 includes a dial locking member 220 with locking teeth 221, and a dial 206 with a plurality of gear recesses 224 and teeth 226, as illustrated in FIG. 5. The dial 206 further includes a tool receiving feature 208 that may be engaged by a user of the golf club head 200. Once the tool receiving feature 208 is engaged, the user may rotate the dial 206, which engages and translates the weight 216 as described below.

The weight 216 includes a plurality of weight recesses 234 and cogs 236 which are designed to mesh with the plurality of gear recesses 224 and teeth 226 of the dial 206. This allows the dial 206 to engage and translate the weight 216. The weight 216 is made in an arc-like shape in order to match the curvature of the weight channel 214. The curvature of the weight channel 214 is what causes the c.g. location to change along both the x-axis and z-axis. The weight 216 may also be made of an elastomeric material creating an elastomeric body 228, with reliefs 237 on the side opposite the cogs 236, allowing for smooth translation along the weight channel 214. The weight channel 214 may have variable radii along the skirt 207 portion of the golf club head 200, and the elastomeric body 228 of the weight 216, paired with the reliefs 237, allows the weight 216 to flex and conform to the channel 214 to translate smoothly along a variable radii channel. The elastomeric body 228 may also be configured to include a plurality of insert bores 232 which house and contain a plurality of weight inserts 230. These weight inserts 230 may be made of a material with a higher density than the elastomeric body 228. These weight inserts 230 can vary in weight, allowing a user to find a preferred adjustment to the location of the c.g. of golf club head 200.

In a preferred embodiment, the length of the weight 216 may generally be about 30-70 mm, more preferably about 40-60 mm, and most preferably about 45-55 mm. The length of the weight channel 214 may generally be about 70-110 mm, more preferably about 80-100 mm, and most preferably about 85-95 mm. The adjustable weight system 202 may provide at least 1 mm of c.g. location adjustment, more preferably at least 2 mm of c.g. location adjustment, more preferably at least 3 mm of c.g. location adjustment, more preferably at least 4 mm of c.g. location adjustment, and more preferably at least 5 mm of c.g. location adjustment.

The dial 206 and weight 216 gear system in the present invention substantially resembles a rack and pinion gear system. Generally, a rack and pinion gear system converts rotational motion into straight linear translational motion. In the current embodiment, the gear system converts rotational motion into translational motion that travels in an arc. This allows the weight 216 to travel along the skirt 206 of the golf club head 200. The current invention may include a more traditional rack and pinion type gear system without departing from the scope of the invention. The placement of the adjustable weight system 202 along the skirt 206 of the golf club head 200 increases the moment of inertia about the y-axis.

In other embodiments, the weight 216 can be made up of a variety of materials such as stainless steel, aluminum, titanium, or other composite or polymeric materials without departing from the scope of the current invention. The weight inserts 230 may also vary in weight and type of material without departing from the scope of the current invention. Examples of material type include steel, tungsten, zirconium, etc.

FIG. 5 illustrates the components of the locking mechanism of the current embodiment. The cover locking feature 238 of the dial cover 210 is designed to substantially retain and selectively lock the dial locking member 220 of the dial 206. The cover locking feature 238 comprises a plurality of recesses 239 formed in said cover which engage and selectively lock the plurality of dial locking teeth 221 when the locking mechanism is in a locked position. The locking teeth 221 may be tapered, and protrude from the dial 206 a height H. As illustrated, there are six locking teeth 221 on the dial locking member 220, and six matching cover locking feature recesses 239. Other embodiments may include more or less than six locking teeth 221 and six cover locking feature recesses 239, without departing from the scope of the current invention.

The spring 240, in its free state, forces the dial locking member 220 inside the cover locking feature 238 of the dial cover 210, allowing the cover locking feature recesses 239 to engage the locking teeth 221 of the dial locking member 220. Locking the dial 206 to the dial cover 210 in this manner ensures that the dial 206 cannot move relative to the dial cover 210 while in a locked position, and fixes the position of the weight 216 inside the weight channel 214. This also minimizes vibrations and helps to prevent rattling noises in the golf club head 200 when the striking face 104 strikes a golf ball.

Figure 6:
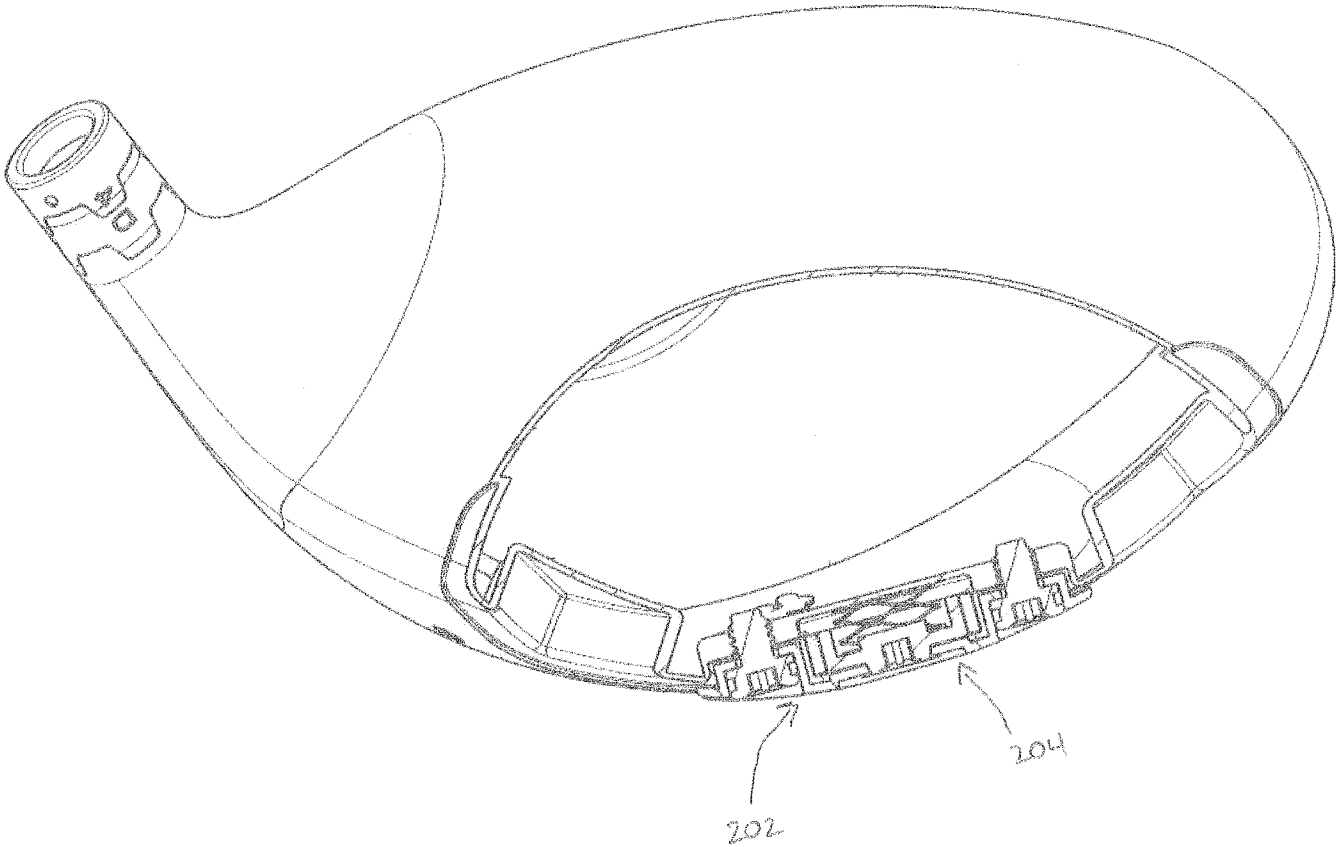
FIG. 6 illustrates a cross sectional view A-A of the golf club head of FIG. 2 showing an adjustable weight system in a locked position.
Figure 8:
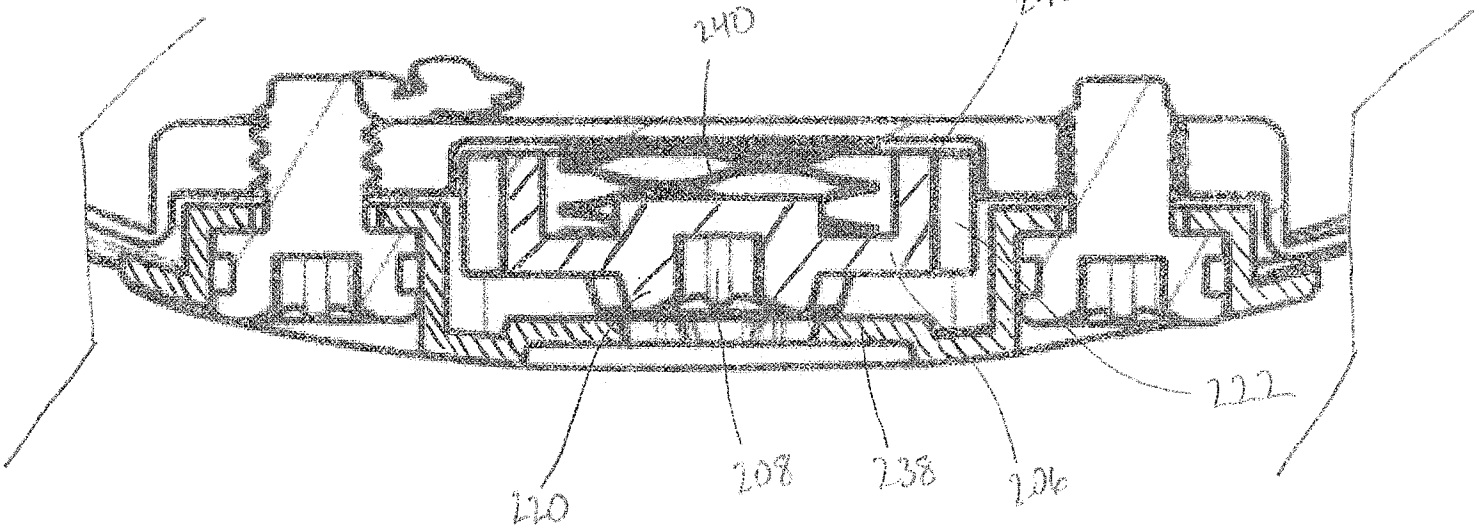
FIG. 8 illustrates a detail view of the adjustable weight system of FIG. 6 in an unlocked position.
Figure 9:
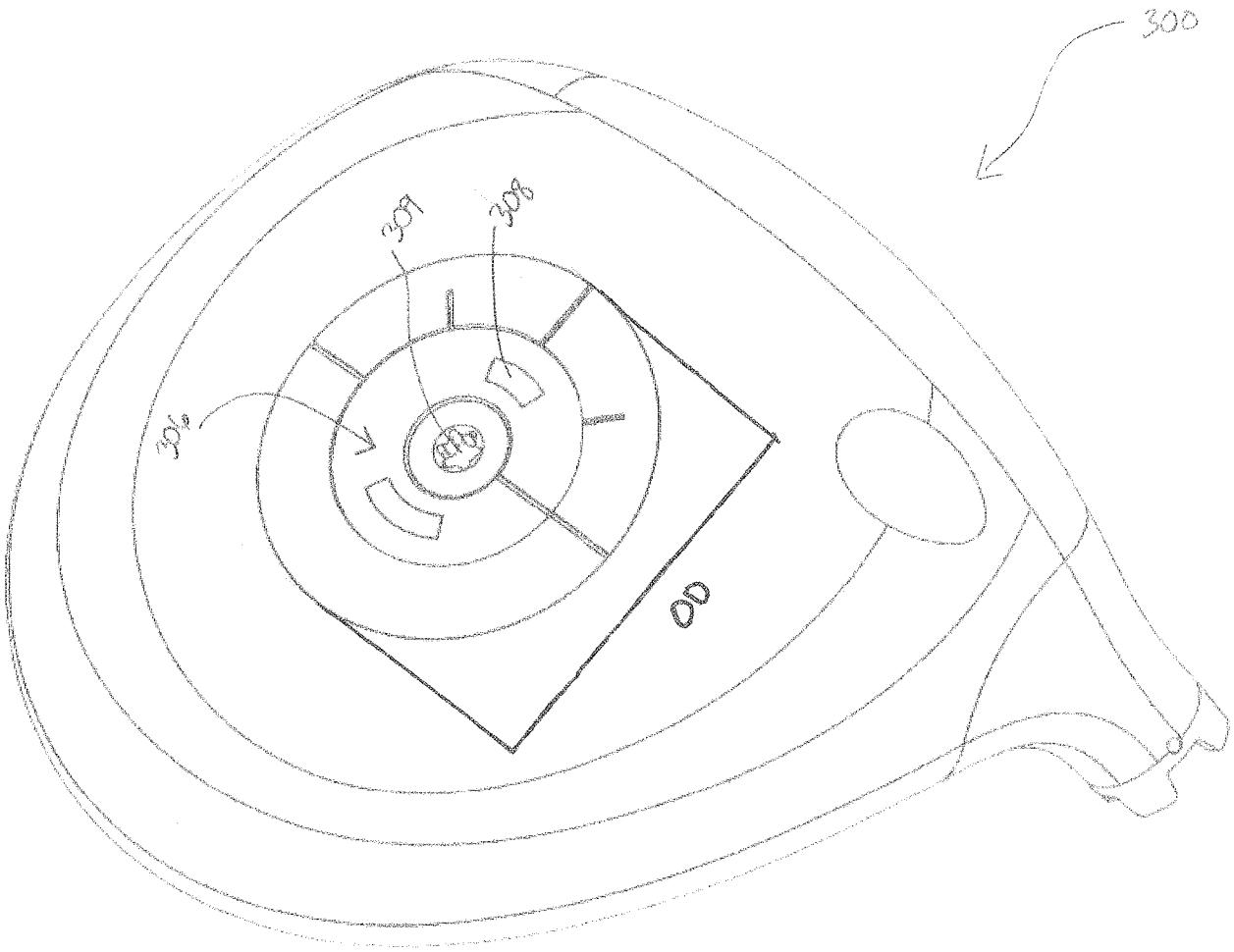
FIG. 9 illustrates a perspective view of an additional embodiment of a golf club head including an adjustable weight system configured to adjust the center of gravity of the golf club head.

FIG. 6 illustrates a cross sectional view of golf club head 200 cut through the line A-A shown in FIG. 2. FIG. 7 illustrates a detail view of the adjustable weight system of FIG. 6 in a locked position. FIG. 8 illustrates a detail view of the adjustable weight system of FIG. 6 in an unlocked position. A user can engage the tool receiving feature 208 of the dial 206 and force the adjustable weight system 202 from a locked position, as shown in FIG. 7 into an unlocked position, as shown in FIG. 8, by applying a force, parallel to the axis of rotation of the dial 206, that compresses the spring 240 to disengage the dial locking member 220 from the dial cover 210. When in the unlocked position, the dial 206 can be rotated relative to the dial cover 210 and be clocked into a plurality of angular positions, where each of the plurality of dial locking teeth 221 correspond to a new angular position. Each of these positions correspond to a plurality of positions for the weight 216, and thus create a plurality of c.g. locations. Once the desired position is found for the weight 216, the user can disengage the tool receiving feature 208 and the spring 240 will force the dial 206 back into a locked position, shown in FIG. 7, where the plurality of dial locking teeth 221 are re-engaged inside the cover locking feature 238. The locked position prevents any rotational motion of the dial 206 relative to the dial cover 210.

The width W of the recess 242 is larger than the diameter D1 of the dial 206, providing sufficient clearance for the dial 206 when the dial 206 is forced into the unlocked position, as illustrated in FIGS. 7-8. This minor clearance not only provides the dial 206 room to rotate while in an unlocked position, but also prevents the dial 206 from falling out of alignment before the spring 240 forces it back into a locked position. The distance D2 between the base of the cavity 242 and the dial 206 in a locked configuration is greater than the height H of the dial locking member 220, providing sufficient clearance for the dial 206 to translate away from the dial cover 210 and allowing the locking teeth 221 of the dial locking member 220 to disengage the cover locking member recesses 239.

In a preferred embodiment, the width W of the cavity 242 may generally be 0.5-2 mm greater than the diameter D1 of the dial 206, more preferably about 0.5-1.5 mm greater, and most preferably no smaller than 0.5 mm greater. The height H of the locking teeth 221 of the dial locking member 220 may generally be about 0.5-3 mm, more preferably about 1-2.5 mm, and most preferably about 1.5-2 mm. Further, the depth D2 of the cavity 242 is preferably no smaller than about 0.5 mm greater than the height H of the locking teeth 221 of the dial locking member 220.

An additional embodiment of a golf club head 300 with an adjustable weight system 302 is shown in FIGS. 9-15. The drive and locking mechanism of the adjustable weight system in this embodiment are similar to that of the golf club head of FIGS. 2-8. In this embodiment, the locking mechanism directly prevents movement of both the drive mechanism and the slidable weight 316.

Figure 10:
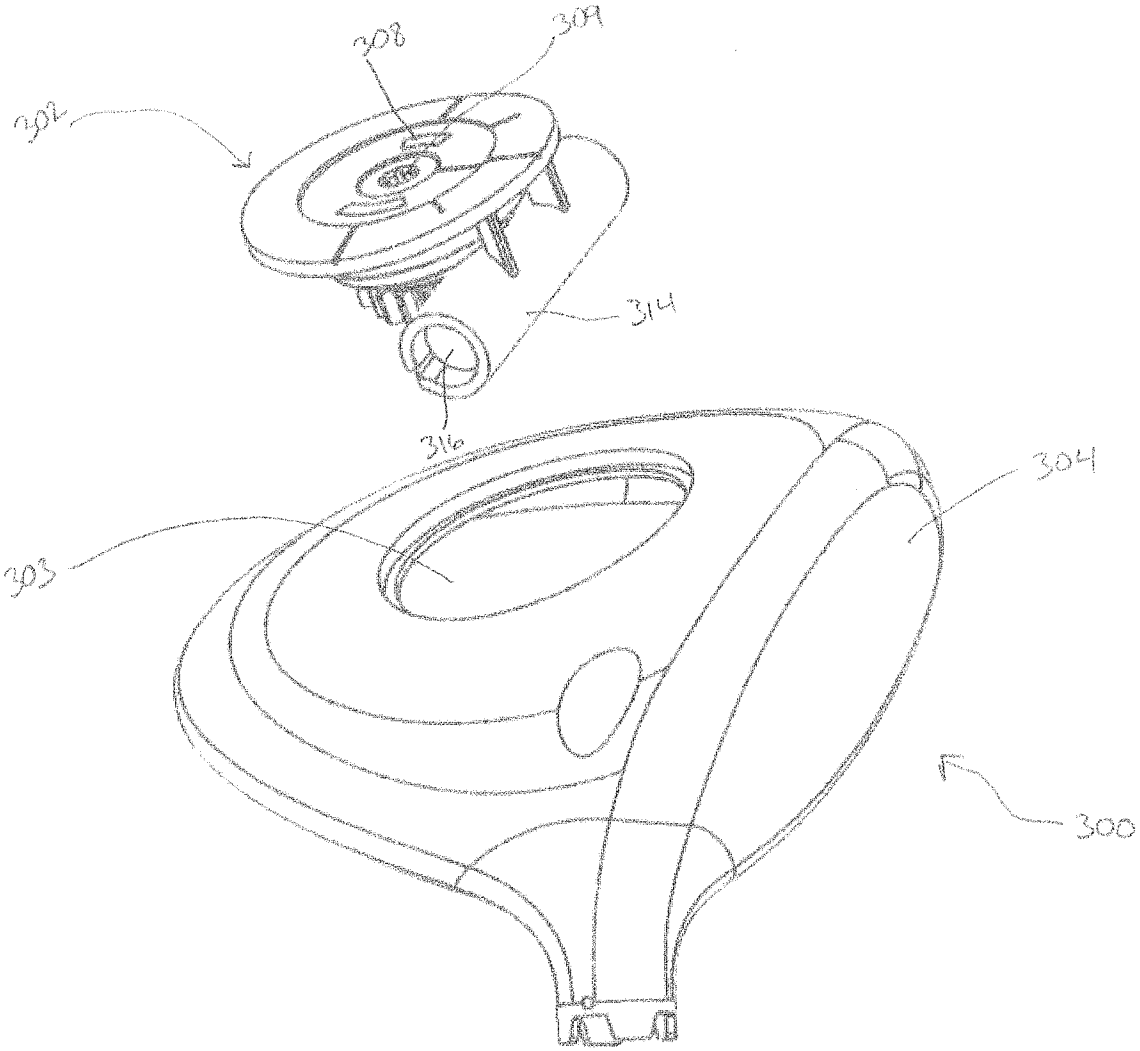
FIG. 10 illustrates an exploded view of the golf club head of FIG. 9 with an adjustable weight system above an aperture of the golf club head.

In the current embodiment, the adjustable weight system 302 is constructed separately from the golf club head 300. In the illustrated embodiment, the golf club head 300 includes an aperture 303 in the body which is designed to receive and retain a completely constructed adjustable weight system 302, as shown in FIG. 10.

Figure 11:
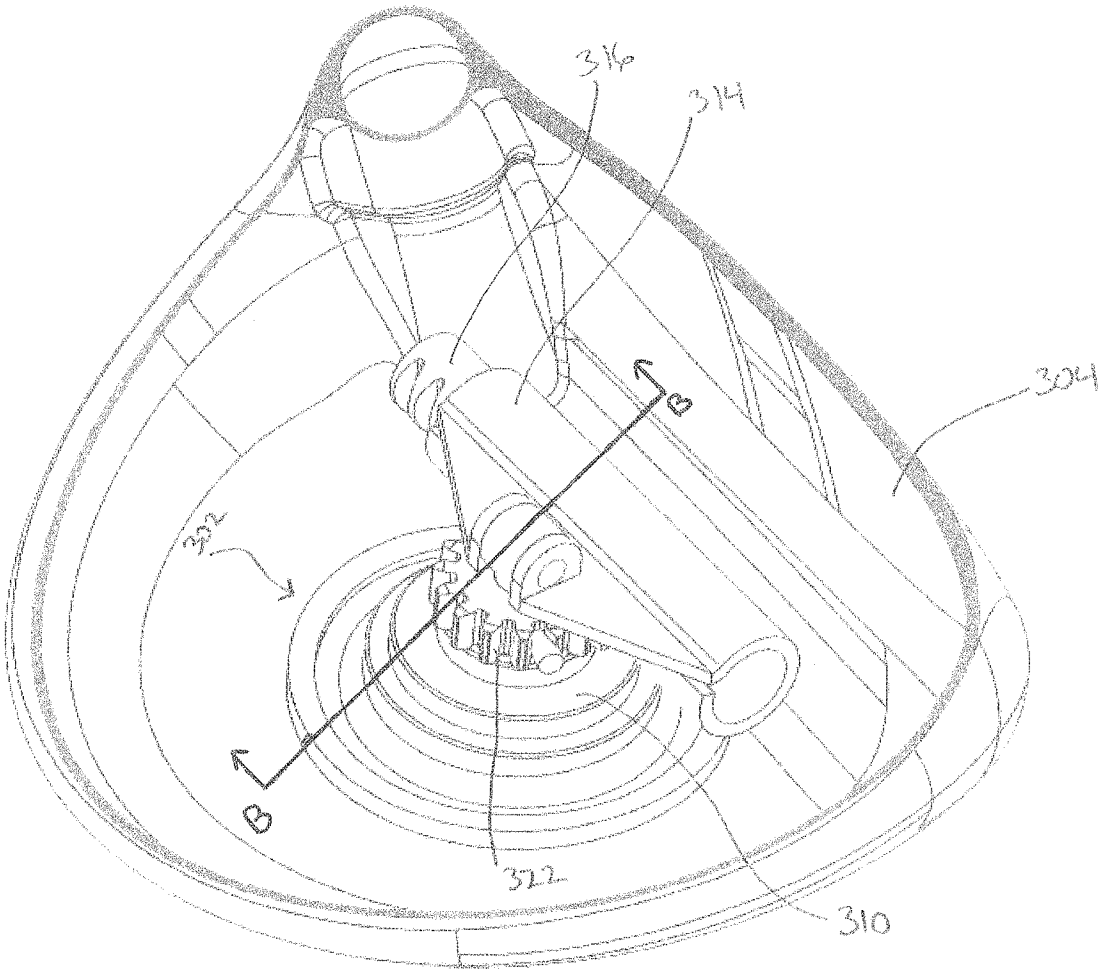
FIG. 11 illustrates a view of the interior of the golf club head of FIG. 9 with an adjustable weight system installed inside the hollow body of the golf club head.

As illustrated in FIG. 11, the adjustable weight system 302 is configured such that the weight 316 is located behind and in close proximity to the striking face portion 304 of the club head 300. In this configuration, the weight 316 lies substantially parallel to the striking face 304 and can change the c.g. location of the club head 300 along the x-axis. It should be noted that the adjustable weight system 302 may be clocked in a plurality of angular positions within the aperture 303, allowing the weight 316 to manipulate the c.g. location in other directions. The adjustable weight system 302 may also include weights 316 of varying weight, varying the severity of c.g. location adjustment inside the golf club head 300. Thus, the weight 316 is able to change the c.g. location of the club head 300 along the x-axis, the z-axis, or both the x-axis and z-axis, depending on the orientation of the adjustable weight system 302 within the aperture 303 without departing from the scope of the current invention.

In a preferred embodiment, the outside diameter OD of the adjustable weight system 302 is generally about 20-60 mm, more preferably about 30-50 mm, and most preferably about 35-45 mm. Further the height H2 of the adjustable weight system 302 may generally about 10-40 mm, more preferably about 15-35 mm, and most preferably about 20-30 mm.

Figure 12:
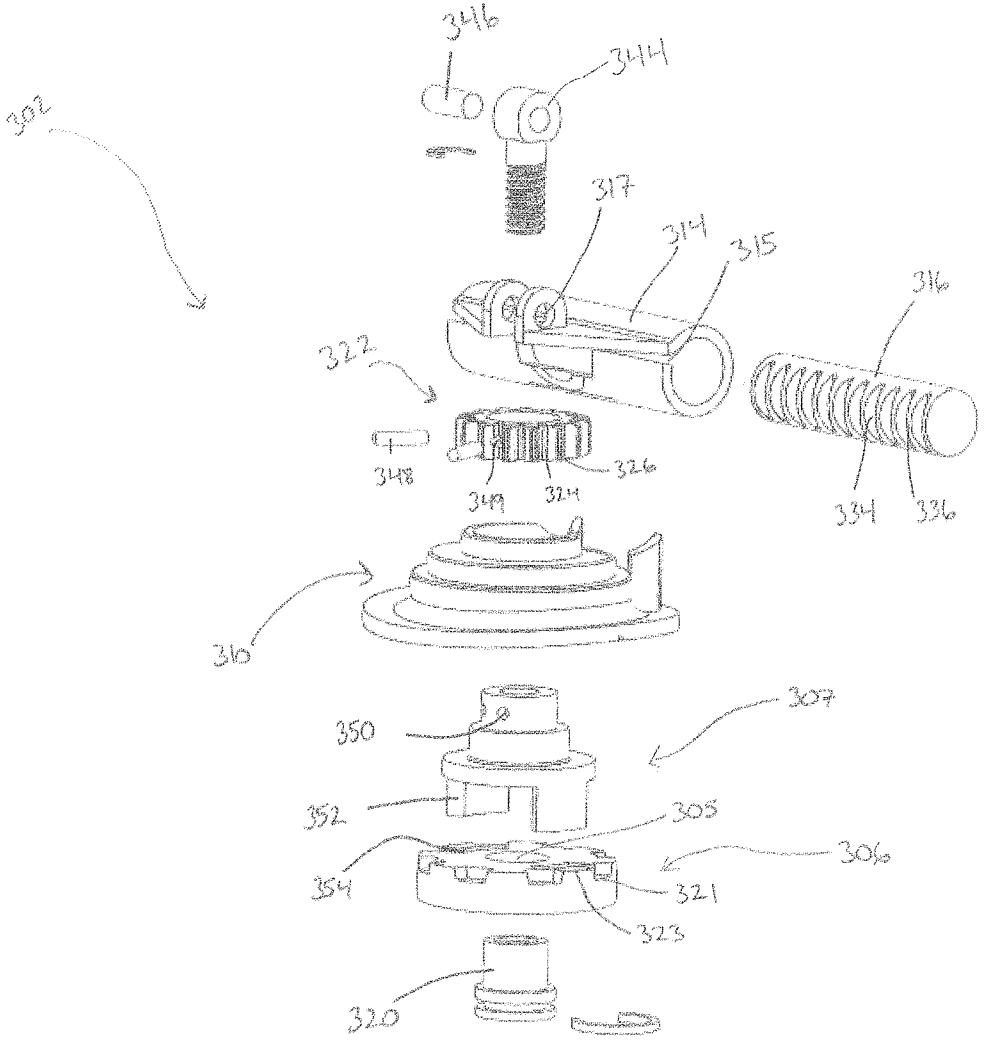
FIG. 12 illustrates an exploded view of the adjustable weight system of FIG. 9.
Figure 14:
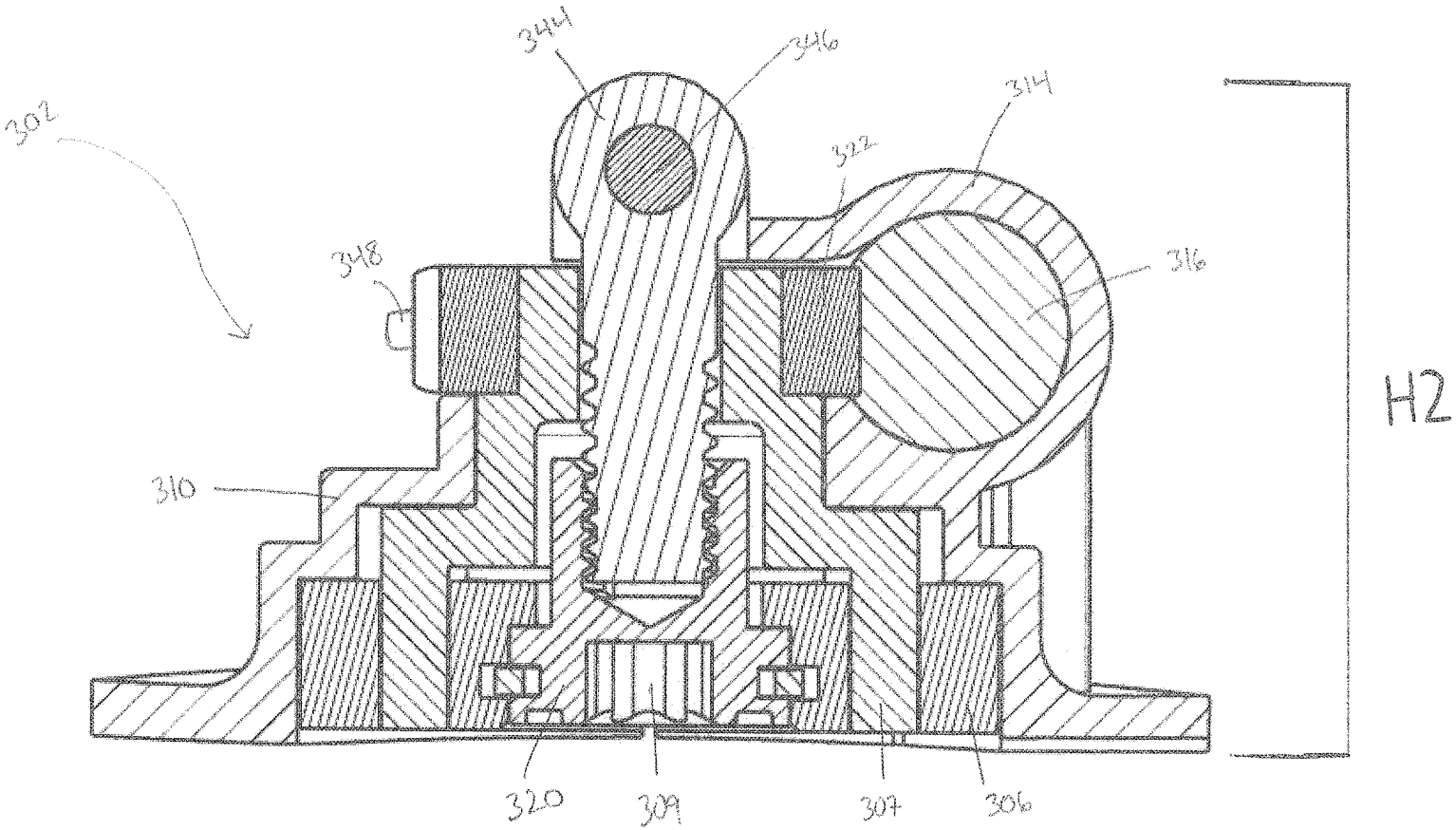
FIG. 14 illustrates a cross sectional view B-B of the adjustable weight system of FIG. 9 in a locked position.
Figure 15:
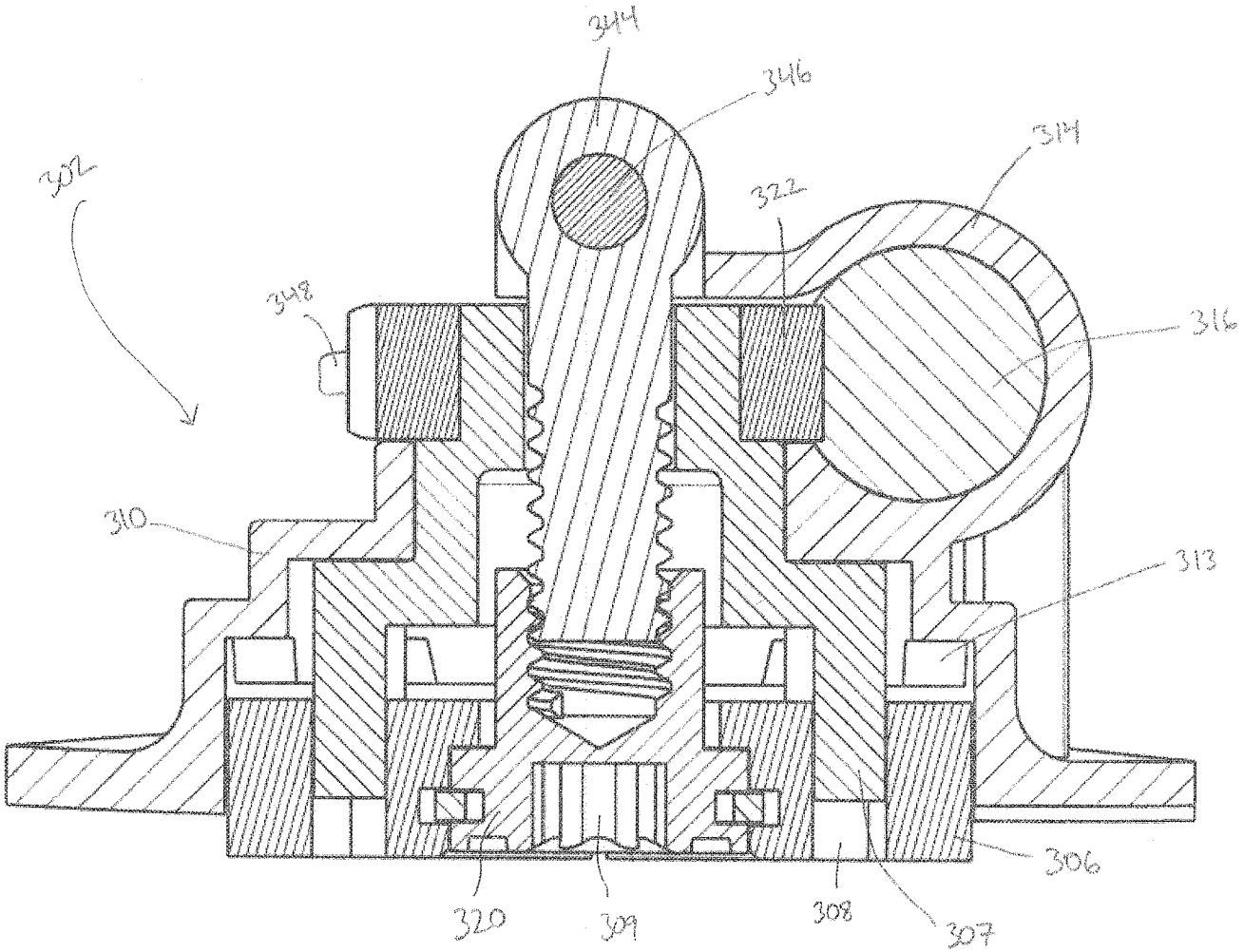
FIG. 15 illustrates the cross sectional view B-B of the adjustable weight system of FIG. 14 in an unlocked position.

As shown in FIGS. 12, 14, and 15, the drive mechanism in the current embodiment includes a torque transfer member 307 in addition to a gear 322. The dial 306 is coupled to the torque transfer member 307, which is further coupled to the gear 322. The torque transfer member 307 uses the dial's 306 rotational motion to rotate the gear 322 which translates the weight 316 linearly along the weight channel 314. The drive mechanism rotates about an axis of rotation which is perpendicular to the axis of translation of the weight 316 at an interface of the drive mechanism and the weight 316. As illustrated in FIGS. 11, 12, and 15, the weight 316 in the current embodiment travels along a straight axis of translation and thus the axis of rotation is perpendicular to the entire axis of translation.

The locking mechanism in the current embodiment includes a fastener 344 which couples to a dial locking member 320, to ultimately retain the whole adjustable weight system 302, in a locked position. After unlocking the system using a tool receiving feature 309 in the dial locking member 320, a second tool receiving feature 308 is then accessible in the dial 316, and can be engaged in order to rotate the dial 306 and translate the weight 316.

FIG. 12 illustrates an exploded view of the adjustable weight system 302. The dial cover 310 houses the dial 306, torque transfer member 307, and dial locking member 320. The gear 322 receives rotational motion from the dial 306 through the torque transfer member 307. The gear 322 meshes with the weight 316 and uses rotational motion to translate the weight 316 in a linear fashion. In other embodiments, the weight 316 could translate along a curved path similar to the embodiment illustrated in FIGS. 2-8. The fastener 344 engages the dial locking member 320, and is tightened to put the adjustable weight system 302 in a locked configuration, and prevent vibration and rattling when the striking face 304 strikes a golf ball. As mentioned above, this adjustable weight system 302 can be constructed separately from the golf club head 300 and be oriented into the golf club head 300 after construction.

The dial 306 includes a bore 305 configured to receive the dial locking member 320. The dial locking member 320 is rotatably connected to the dial 306 with a snap ring. The dial 306 further includes a plurality of dial recesses 321, a plurality of locking teeth 323, and dial apertures 354. The plurality of dial recesses 321 and locking teeth 323 are designed to substantially lock the dial 306 inside of the dial cover 310, which will be described in more detail below. The dial apertures 354 are designed to slidably receive a plurality of teeth 352 of the torque transfer member 307 in order to prevent the torque transfer member 307 from rotating relative to the dial 306, while still allowing relative translational motion parallel to the axis of rotation.

The plurality of teeth 352 of the torque transfer member 307 reside on the dial end of the tubular body of the torque transfer member 307. There is also a gear end of the torque transfer member 307, wherein there exists at least one torque transfer member bore 350 configured to receive at least one pin 348. FIG. 12 illustrates two torque transfer member bores 350 and two pins 348, but the system can be constructed with more or less than two torque transfer member bores 350 or two pins 348, without departing from the scope of the invention. The torque pins 348 couple the gear 322 to the gear end of the torque transfer member 307 by engaging the gear bores 349 on the gear 322 and the torque transfer member bores 350 on the torque transfer member 307. The number of gear bores 349 match the number of torque transfer member bores 350. Thus, when the dial 306 receives rotational motion, the torque transfer member 307 can transfer that motion to the gear 322. The pins 348 also limit the travel of the gear 322, providing a predetermined amount of rotation before the pins 348 abut the weight channel 314 and prevent the gear 322 from rotating further.

The weight 316 and weight channel 314 of the current embodiment share the same cross-sectional shape. As illustrated, the weight 316 and weight channel 314 are cylindrical, but these two components may be of any other shape, such as a square, without departing from the scope of the current invention. The weight 316 includes a plurality of weight recesses 334 and weight cogs 336 which are designed to complement and mesh with the plurality of gear recesses 324 and gear teeth 326 of the gear 322. This allows the gear 322 to engage the weight while rotating and to translate the weight 316.

The weight channel 314 in this embodiment includes a weight channel locking portion 317 and a weight channel slot 315. When the adjustable weight system 302 is in a locked position, the weight channel slot 315 is forced closed so as to keep the weight 316 fixed in a desired position. When the adjustable weight system 302 is in an unlocked position, the weight channel slot 315 expands and allows the weight 316 to translate. The weight channel locking portion 317 is configured to substantially retain a fastener locking member 346 in order to hold the fastener 344 in place.

The weight 316 and weight channel 314 may be composed of a variety of materials such as stainless steel, aluminum, titanium, or other composite or polymeric materials without departing from the scope of the current invention.

In a preferred embodiment, the weight channel 314 may generally be about 25-65 mm in length, more preferably about 35-55 mm, and most preferably about 40-50 mm. The weight 316 may generally translate from the midpoint of the weight channel 314, to the edge of the golf club head 300 in each direction. The distance of translation may generally be about 21-63 mm, more preferably about 30-50 mm, and most preferably about 30-40 mm.

Figure 13:
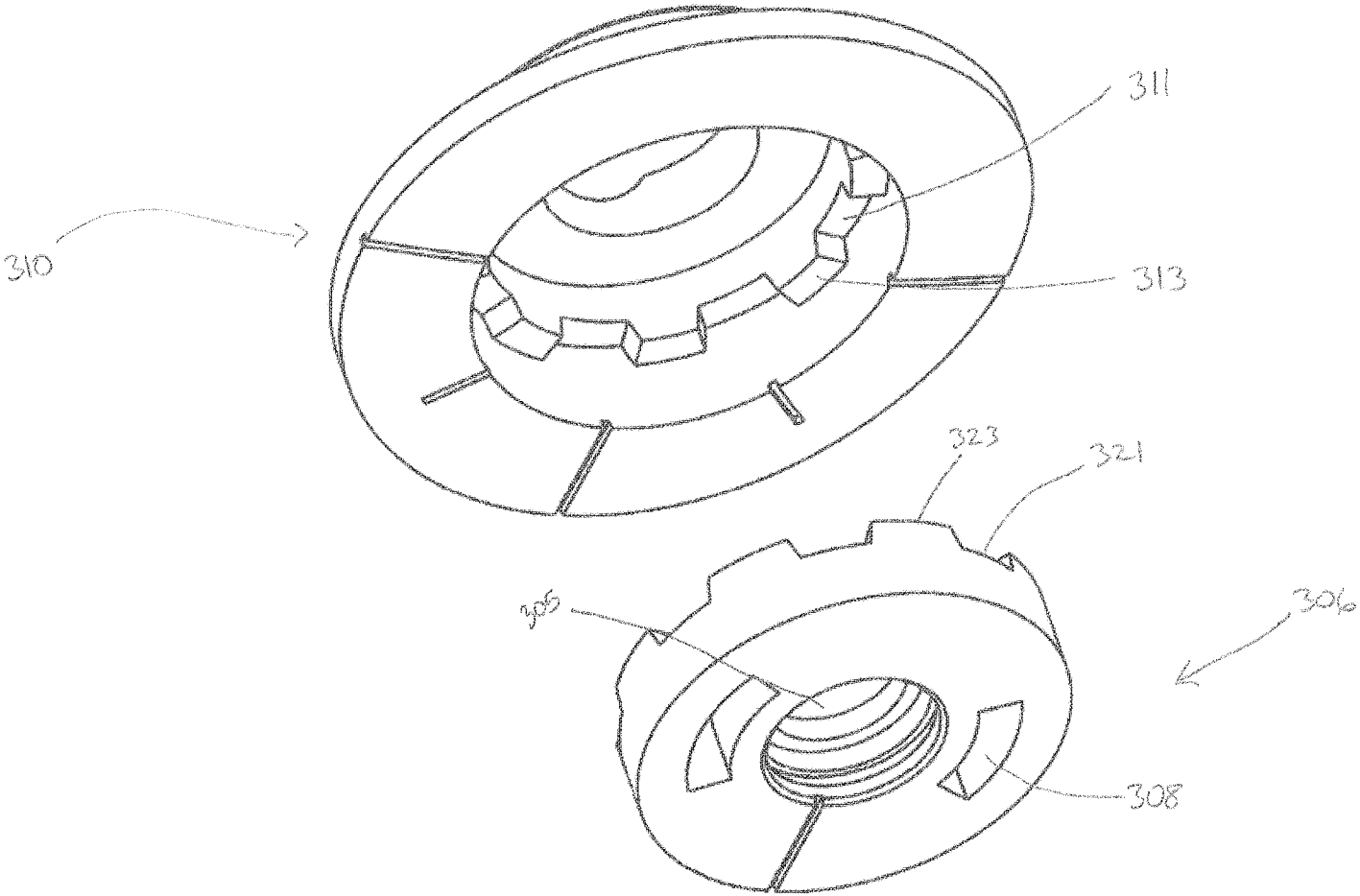
FIG. 13 illustrates an exploded perspective view of the dial and dial cover of FIG. 12

The fastener 344 includes a shank that extends from the weight channel 314 to the dial locking member 320. When the fastener 344 is fully tightened inside the dial locking member 320, the plurality of dial cover recesses 311 and dial cover cogs 313 substantially receive and lock the plurality of dial recesses 321 and dial locking teeth 323, as shown in FIG. 13. This is done in order to hold the dial 306 in place and prevent rotational motion relative to the dial cover 310 when the system is in a locked position. The fastener 344 being fully tightened inside of the dial locking member 320 also decreases the width of the weight channel slot 315, clamping the weight, as mentioned above, substantially locking the weight 316 in place and preventing translation of the weight inside the weight channel 314.

FIG. 14 illustrates a cross-sectional view of the adjustable weight system 302 along the line B-B shown in FIG. 11 in a locked position. FIG. 15 illustrates the same cross section but in an unlocked position. In order to bring the adjustable weight system 302 into an unlocked position, as illustrated in FIG. 15, a user can engage the tool receiving feature 309, of the dial locking member 320, in order to rotate the dial locking member 320 in a first direction relative to the golf club head and the fastener 344. As the dial locking member 320 is rotated in a first direction relative to the fastener 344, the threads of the fastener 344 drive the dial locking member 320 and dial 306 away from the dial cover 310, forcing the dial locking member 320 and dial 306 to protrude from the sole 312 of the golf club head 300. The fastener 344 is held substantially in place during the unlocking process by the fastener locking member 346. As the dial 306 is driven away from the dial cover 310, the plurality of locking teeth 323 are forced free of the dial cover cogs 313, bringing the dial 306 into an unlocked position where it can now be rotated. When the system is in the locked position, as shown in FIG. 14, a user cannot engage the dial tool receiving feature 308 as it is completely filled by the plurality of teeth 352 of the torque transfer member 307. This allows the teeth 352 to not only prevent the dial 306 from rotating while in a locked position but also prevent dirt and debris from entering the dial tool receiving feature 308 when the golf club head impacts the turf. Rotating the dial locking member 320 in this first direction also allows the weight channel slot 315 to loosen, allowing the weight 316 freedom to translate along the weight channel 314.

When unlocked, the user can rotate the dial 306 in a first direction, with the torque created being transferred to the gear 322 through the torque transfer member 307. The gear 322 then uses this torque to engage and translate the weight 316 in a first direction. The dial 306 can also be rotated in a second direction, opposite the first, and the weight 316 will translate in a second direction, opposite the first. Subsequently, the user can rotate the dial locking member 320 in a second direction, opposite the first, bringing the dial locking member 320 and dial 306 towards the dial cover 310 again as the fastener 344 tightens back into the dial locking member 320. Doing this brings the plurality of locking teeth 323 of the dial 306 back inside of the dial cover recesses 311, so the dial 306 may no longer rotate. Rotating the dial locking member 320 in this second direction also tightens the weight channel slot 315 again in collet style in order to substantially lock the weight 316 in place again.

Figure 16:
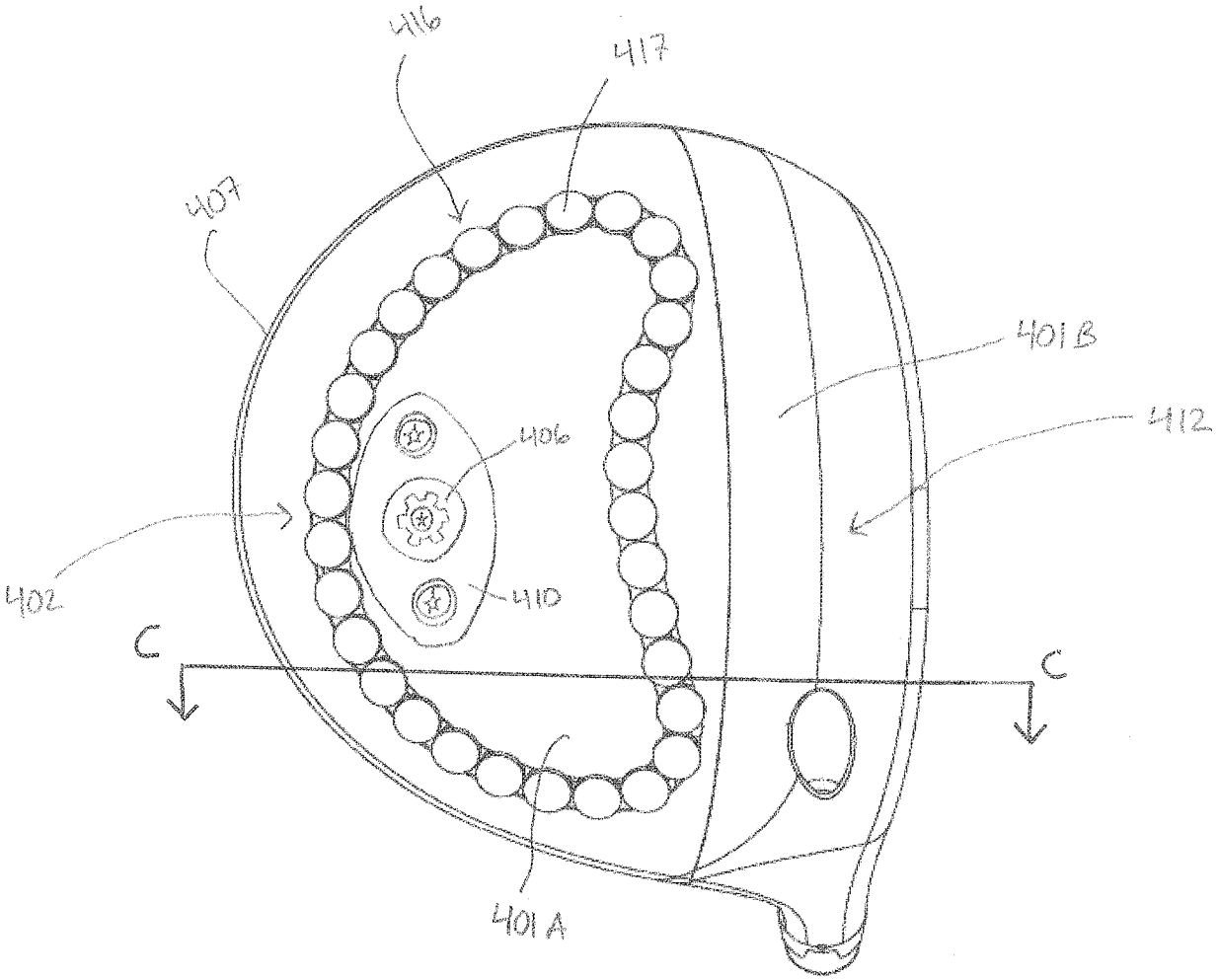
FIG. 16 illustrates a bottom view of an additional embodiment of a golf club head including an adjustable weight system configured to adjust the center of gravity of the golf club head.
Figure 17:
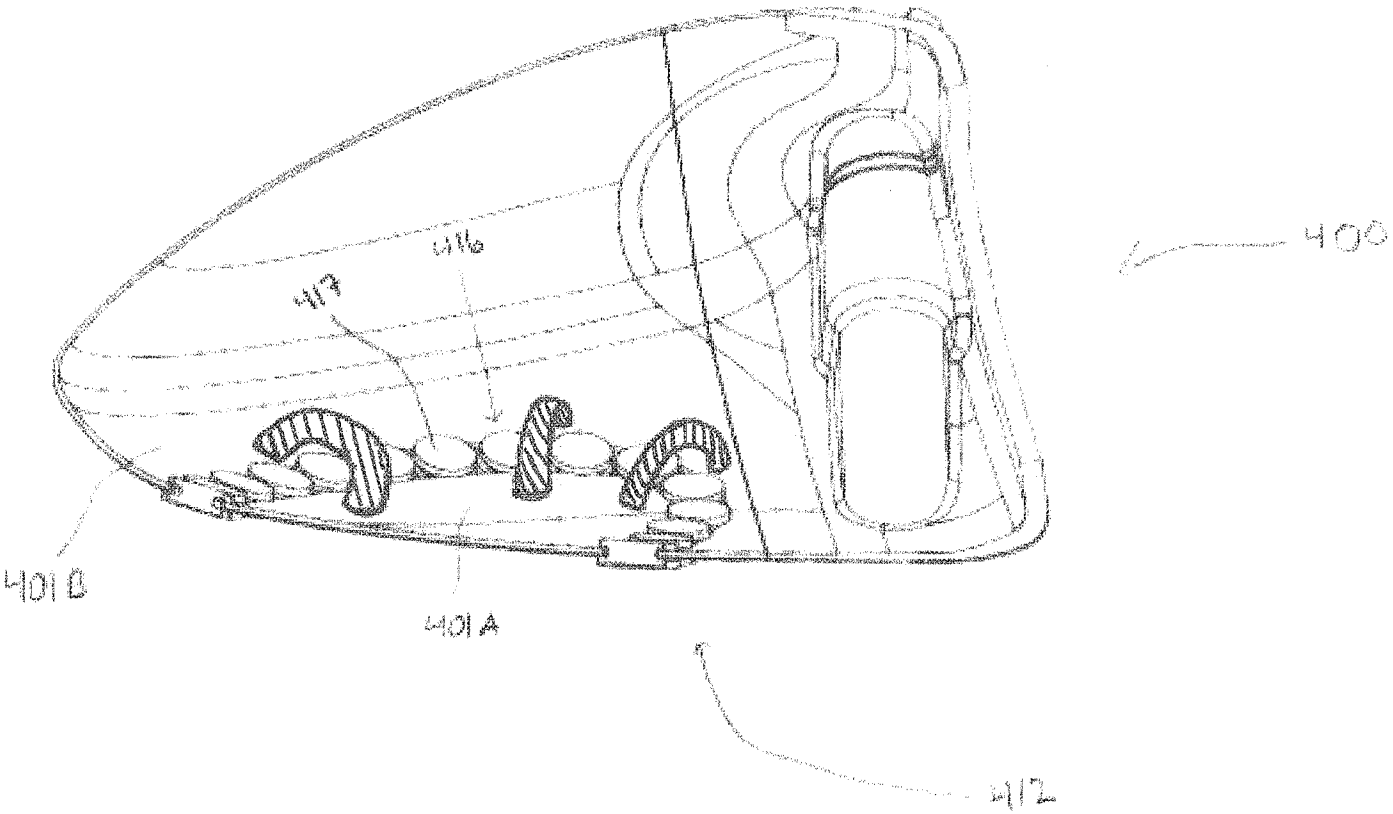
FIG. 17 illustrates a cross sectional view C-C of the golf club head of FIG. 16.
Figure 18:
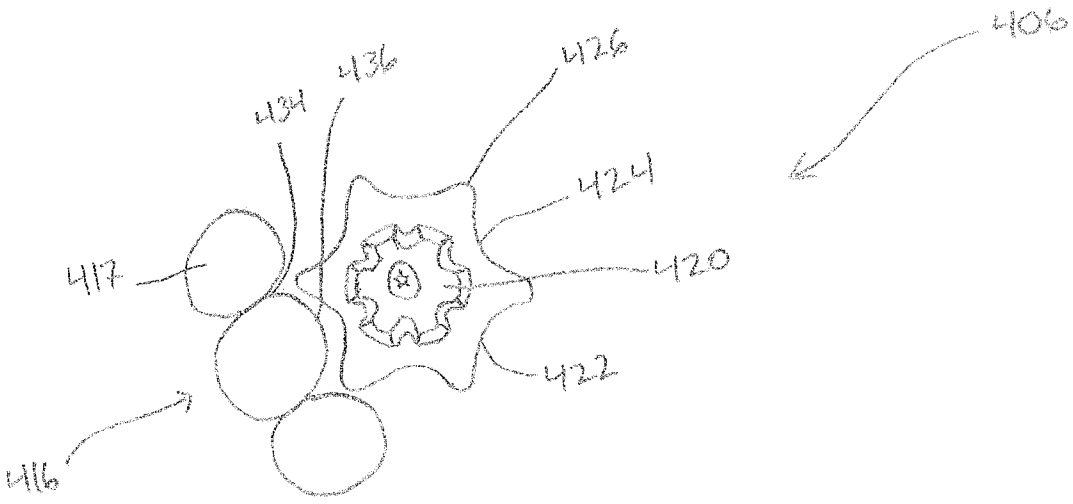
FIG. 18 illustrates the relationship between a dial and weight of the adjustable weight system of FIG. 16.

An additional embodiment of a golf club head 400 with an adjustable weight system 402 is shown in FIGS. 16-18. The drive and locking mechanism of this embodiment is similar to the drive and locking mechanism described in the embodiment of FIGS. 2-8. The axis of translation of the slidable weight 416 may be curved or linear, and is locally perpendicular to the axis of rotation of the gear 422.

The sole 412 is comprised of a first piece 401A and a second piece 401B. These two pieces of the sole 412 may be connected to each other by a plurality of bridge structures, as illustrated in FIG. 17. FIG. 17 illustrates a cross-sectional view of golf club head 400 along the line C-C shown in FIG. 16. The golf club head 400 includes a skirt 407.

The weight 416 includes a plurality of weight components 417 which are circular in shape and combine to form a plurality of weight recesses 434 and weight cogs 436. The weight compartments 417 may be made up of an elastomeric material having low friction, allowing for smooth translational motion through the weight channel 414. This elastomeric material may be solid or hollow and, if hollow, may allow the weight components 417 to encapsulate a second weight of varying density inside. Adjusting the c.g. location of golf club head 400 is made possible by one, or a portion, of the weight components 417 being greater in mass than the others. The c.g. location of golf club head 400 will bias towards wherever the heavier weight components 417 of the adjustable weight system 402 are positioned. In this embodiment, the c.g. location of golf club head 400 may be adjusted on both the x-axis and z-axis.

The locking and unlocking process in the present embodiment is substantially similar as the process described in FIGS. 2-8 above. The only slight difference being the shape of the weight cogs 436 and gear teeth 426. Since the weight components 417 are round, the plurality of gear recesses 424 and gear teeth 426 are altered slightly to substantially mesh with the plurality of weight recesses 434 and weight cogs 436, as shown in FIG. 18. The adjustable weight system 402 includes a dial 406, a dial cover 410, and a dial locking member 420.

Figure 19:
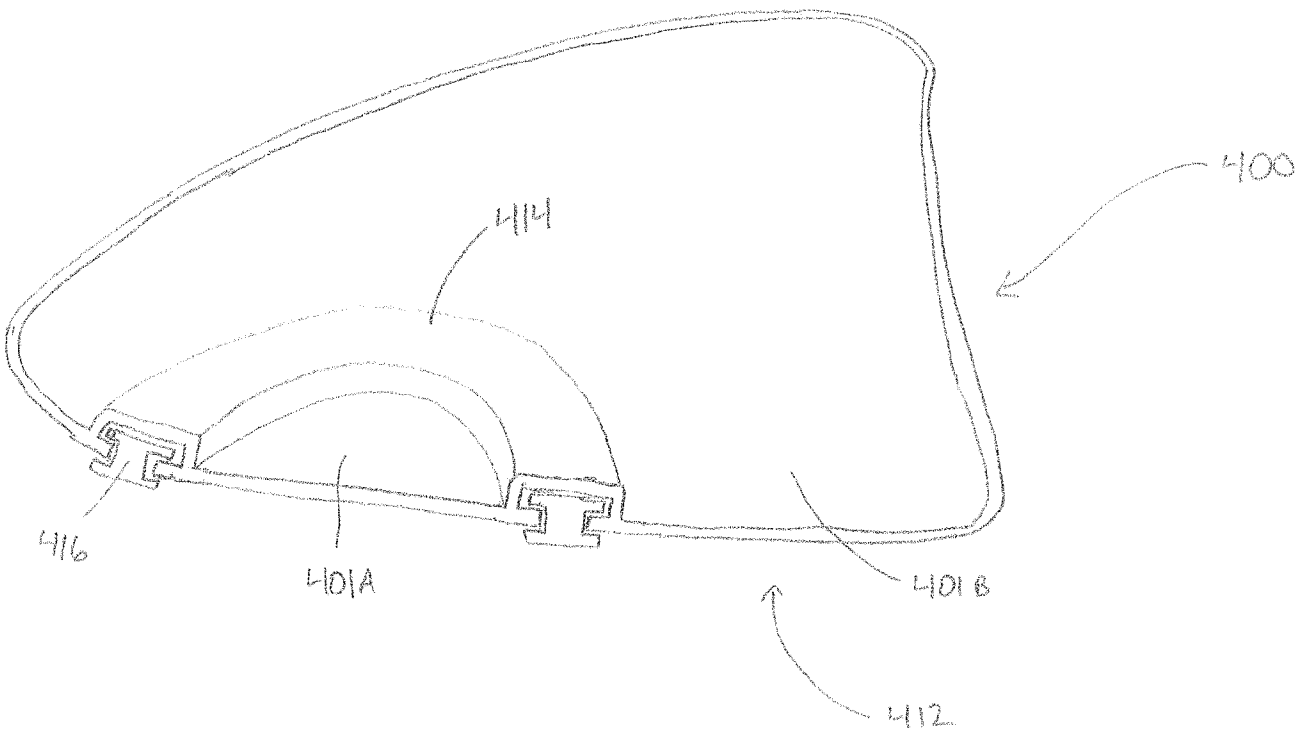
FIG. 19 illustrates a cross sectional view C-C of an additional embodiment of the adjustable weight system of the golf club head of FIGS. 16 and 17.

An additional embodiment of the golf club head of FIGS. 16 and 17 is illustrated in FIG. 19 which features a weight channel 414.

In describing the present technology herein, certain features that are described in the context of separate implementations also can be implemented in combination in a single implementation. Conversely, various features that are described in the context of a single implementation also can be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure as well as the principle and novel features disclosed herein.

We claim:

1. A golf club head, comprising;

A body having a face defining a ball striking surface, a crown extending from an edge of said face, a sole extending from an edge of said face, and a skirt extending between said crown and said sole; and an adjustable weight system comprising a drive mechanism, a locking mechanism, and a weight;

wherein said drive mechanism is rotatable about an axis of rotation, and said weight is slidable along an axis of translation;

wherein said axis of rotation is perpendicular to said axis of translation at an interface of said drive mechanism and said weight;

wherein said drive mechanism comprises a plurality of teeth;

wherein said weight comprises a plurality of cogs that complement said plurality of teeth of said drive mechanism;

wherein said plurality of teeth of said drive mechanism engage said plurality of cogs of said weight so that rotation of said drive mechanism about an axis of rotation forces said weight to translate along said axis of translation;

wherein a component of said locking mechanism translates between an unlocked position and a locked position in a direction parallel to said axis of rotation of said drive mechanism; and wherein said locking mechanism directly engages and prevents movement of at least one of said drive mechanism and said slidable weight.

2. The golf club head of claim 1, wherein said golf club head comprises a curved weight channel.

3. The golf club head of claim 2, wherein said weight channel comprises a plurality of radii of curvature.

4. The golf club head of claim 2, wherein said weight is flexible, allowing said weight to conform and translate smoothly along said curved weight channel.

5. The golf club head of claim 1, wherein said adjustable weight system comprises a first set of teeth located on said drive mechanism, and a second set of teeth affixed to said body, wherein said locking mechanism biases said first set of teeth to engage said second set of teeth, locking said locking mechanism, and wherein forcing said first set of teeth in a direction parallel to said axis of rotation disengages said first set of teeth from said second set of teeth, unlocking said locking mechanism.

6. The golf club head of claim 5, wherein said locking mechanism comprises a spring configured to bias said first set of teeth to engage said second set of teeth.

7. The golf club head of claim 5, wherein said locking mechanism comprises a fastener configured to bias said first set of teeth to engage said second set of teeth.

8. The golf club head of claim 1, wherein said adjustable weight system is constructed separately from said golf club head and affixed to said golf club head.

9. The golf club head of claim 1, wherein said body comprises an aperture formed therein, and wherein said adjustable weight system is affixable to said golf club head in a plurality of angular positions.

10. The golf club head of claim 1, wherein said adjustable weight system further comprises a weight channel, wherein said weight channel comprises a slot, and wherein the cross section of said weight channel complements the cross section of said weight.

11. A golf club head, comprising;

A body having a face defining a ball striking surface, a crown extending from an edge of said face, a sole extending from an edge of said face, and a skirt extending between said crown and said sole; and an adjustable weight system comprising a drive mechanism, a locking mechanism, and a weight;

wherein said drive mechanism is rotatable about an axis of rotation, and said weight is slidable along an axis of translation;

wherein said axis of rotation is perpendicular to said axis of translation at an interface of said drive mechanism and said weight;

wherein said weight resides in a curved weight channel;

wherein said weight is flexible, allowing said weight to conform and translate smoothly along said weight channel;

wherein said drive mechanism comprises a plurality of teeth;

wherein said weight comprises a plurality of cogs that complement said plurality of teeth of said drive mechanism;

wherein said plurality of teeth of said drive mechanism engage said plurality of cogs of said weight so that rotation of said drive mechanism about an axis of rotation forces said weight to translate along said axis of translation;

wherein a component of said locking mechanism translates between an unlocked position and a locked position in a direction parallel to said axis of rotation of said drive mechanism; and wherein said locking mechanism directly engages and prevents movement of at least one of said drive mechanism and said slidable weight.

12. The golf club head of claim 11, wherein said weight channel comprises a plurality of radii of curvature.

13. The golf club head of claim 11, wherein said weight channel is adjacent said skirt of said body.

14. The golf club head of claim 11, wherein said weight is formed of an elastomeric material.

15. The golf club head of claim 14, wherein said weight further comprises a plurality of insert bores, each configured to house a weight insert.

16. A golf club head, comprising;

A body having a face defining a ball striking surface, a crown extending from an edge of said face, a sole extending from an edge of said face, and a skirt extending between said crown and said sole; and an adjustable weight system comprising a drive mechanism, a locking mechanism, and a weight;

wherein said drive mechanism is rotatable about an axis of rotation, and a weight that is slidable along an axis of translation;

wherein said axis of rotation is perpendicular to said axis of translation at an interface of said drive mechanism and said weight;

wherein said drive mechanism comprises a dial locking member, said dial locking member comprises a plurality of locking teeth and a plurality of drive teeth;

wherein said locking mechanism comprises a dial cover comprising a locking feature;

wherein said locking feature of said dial cover engages said locking teeth of said dial locking member, directly preventing the rotational movement of said drive mechanism when said locking mechanism is in a locked position;

wherein engaging said drive mechanism and applying a force parallel to said axis of rotation translates said dial locking member from a locked position to an unlocked position;

wherein said weight comprises a plurality of cogs that complement said plurality of drive teeth of said drive mechanism; and wherein said plurality of drive teeth of said drive mechanism engage said plurality of cogs of said weight so that rotation of said drive mechanism about an axis of rotation forces said weight to translate along said axis of translation.

17. The golf club head of claim 16, wherein rotating said drive mechanism, while in said unlocked position, in a first direction causes said weight to translate in a first direction, and wherein rotating said drive mechanism, while in said unlocked position, in a second direction, opposite the first, causes said weight to translate in a second direction, opposite the first.

18. The golf club head of claim 16, wherein said locking mechanism further comprises a spring configured to bias said locking teeth of said dial locking member to engage said locking feature of said dial cover, and applying said force parallel to said axis of rotation compresses said spring and disengages said dial locking member from said dial cover.

19. The golf club head of claim 16, wherein said locking teeth of said dial locking member protrude towards said cover.

20. The golf club head of claim 19, wherein said drive mechanism further comprises a dial, and wherein said body comprises a cavity configured to house said spring and said dial, and wherein said cavity comprises a cavity width greater than a diameter of said dial, and wherein a distance between a base of said cavity and said dial in an unlocked position is greater than the height of said locking teeth of said dial locking member, allowing the dial to translate to said unlocked position and rotate relative to said body.

* * * * *